United States Patent [19]

Pulda

[11] 3,982,750

[45] Sept. 28, 1976

[54] METHOD FOR TRANSPORTING AND REORIENTING A STACK OF MATERIALS

[75] Inventor: William F. Pulda, Piscataway, N.J.

[73] Assignee: Vanguard Machinery Corporation, Edison, N.J.

[22] Filed: Jan. 29, 1975

[21] Appl. No.: 545,038

[52] U.S. Cl. ..... 271/151; 198/373; 214/8.5 A; 271/3.1

[51] Int. Cl.[2] ..... B65H 1/22

[58] Field of Search ..... 271/3.1, 199–202, 271/265, 270, 151; 198/89, 91, 35, 37; 214/6 C, 8.5 A

[56] References Cited

UNITED STATES PATENTS

| | | | |
|---|---|---|---|
| 1,141,277 | 6/1915 | Smith | 271/201 X |
| 2,553,719 | 5/1951 | Palmer | 198/37 |
| 2,778,477 | 1/1957 | Lundahl | 198/91 |
| 2,829,759 | 4/1958 | Parker | 198/33 |
| 2,901,250 | 8/1959 | Martin | 271/201 |
| 2,966,253 | 12/1960 | Gerrans | 198/37 |
| 3,262,697 | 7/1966 | Krinke | 271/33 |
| 3,297,174 | 1/1967 | Letchworth | 214/6 |
| 3,422,969 | 1/1969 | Miller et al. | 271/3.1 X |
| 3,464,537 | 9/1969 | Thull | 198/89 |
| 3,643,939 | 2/1972 | Nussbaum et al. | 271/3.1 X |
| 3,885,781 | 5/1975 | Krebs | 271/3.1 |

FOREIGN PATENTS OR APPLICATIONS

| | | | |
|---|---|---|---|
| 530,347 | 9/1958 | Canada | 214/8.5 |
| 825,874 | 12/1959 | United Kingdom | 214/8.5 |

*Primary Examiner*—Evon C. Blunk
*Assistant Examiner*—Bruce H. Stoner, Jr.
*Attorney, Agent, or Firm*—George E. Kersey

[57] ABSTRACT

Method employing serially positioned conveyors which are reorientable relative to one another at a common position in order to position an incoming stack of materials for transport and automatic stacking at an output position. The speeds of the conveyors are variable and reversible, and the motive power for both operating the conveyors and reorienting them and associated elements is supplied hydraulically. Transport to the output position is over an inclinable shingling conveyor and a retractable output conveyor.

12 Claims, 28 Drawing Figures

ELEVATION OF BACKREST CONVEYOR 100

ELEVATION OF UPSET CONVEYOR 200

SPEED OF BACKREST CONVEYOR

SPEED OF UPSET CONVEYOR

SPEED OF SHINGLING CONVEYOR

SPEED OF OUTPUT CONVEYOR
SPEED
SPEED
SPEED
SPEED
$T_0$ $T_1$ $T_4$ $T_6$ $T_8$ $T_{10}$ $T_{11}$ $T_{12}$ $T_{13}$ $T_{14}$ $T_{15}$ $T_{16}$ $T_{18}$ $T_{19}$ $T_{20}$ $T_{21}$ $T_{23}$ $T_{24}$ $T_{25}$
TIME

METHOD FOR TRANSPORTING AND REORIENTING A STACK OF MATERIALS

BACKGROUND OF THE INVENTION

This invention relates to the transport of materials and, more particularly, to the automatic transport of sheet material.

It is often necessary to transport sheet material. For example, corrugated or cardboard sheets, which are often received in stack form and are loaded into a hopper of the unit that feeds the sheets to a press to be imprinted with a desired legend.

Although the stacks can be transported manually from a receiving dock and then manually loaded into the hopper, it is desirable to completely automate the handling of the stacks. For that purpose, a number of systems have been proposed, such as those disclosed in U.S. Pat. No. 3,422,969 which issued to J. A. Miller, et al. on Jan. 21, 1969, and U.S. Pat. No. 3,643,939 which issued to H. A. Nussbaum et al. on Feb. 22, 1972. These systems involve the transport of a stack to a position where the stack is upset to permit shingling feed of the sheets to an output location.

The foregoing and other prior art systems have a number of disadvantages. In each case, for example, if there is a mechanical or other failure which requires temporary shutdown of the system for repair, the interposition of the system between the receiving or input station and the output location, interferes with the continued use of the output equipment.

Moreover, in the case of U.S. Pat. No. 3,422,969, upset of the stack for transport to the output location takes place on an incline, as shown in FIG. 2 of the patent, so that the weight of the sheets against one another can interfere with the desired output feed. In addition, as shown in FIG. 3 of the patent, the upset is achieved by the tilting of slats which form a backrest. The slats have to be lowered sufficiently to reduce the weight of the upper sheets of the stack against the lower sheets that are being shingled, but, as a result, there is an inadequate gravitational effect for the proper feed of the upper sheets along the slats.

The system of U.S. Pat. No. 3,422,969 further employs an output conveyor which has a greater angle of inclination than the inclined conveyor that feeds sheets to it. This change in angle of inclination produces a further impediment to the proper feed of sheets to the output location because the impact of the oncoming sheets can produce so much pressure against the sheets on the incline that jamming can result. The system also employs electric motors to drive the conveyors and operate the slats that upset the stack. To produce the necessary drive torque, the motors require significant speed reduction, which adds to the mechanical disadvantages of the system.

The mechanical disadvantages of U.S. Pat. No. 3,422,969 are present to an even greater degree in U.S. Pat. No. 3,643,939, where it is necessary to employ a transfer conveyor that requires rotation with a full load through an angle greater than 90 degrees. In this system electric motors are used to operate the conveyors, but the transfer conveyor is elevated and lowered hydraulically.

Furthermore, the foregoing and other prior art systems have no way of controlling the throughput of the system to assure a continuous, adequate supply of material at the output of the system.

Accordingly, it is an object of the invention to facilitate the automatic transport of sheets of material from an input position to an output position. A related object is to facilitate the upset of a stack of materials and the shingled feed of the upset stack to the output position.

Another object of the invention is to provide a transport system which will not prevent the through-flow of materials when the system is temporarily shutdown, for example, for repair.

Still another object of the invention is to eliminate the need for slats to act as a backrest during the upset of materials that are to be automatically transported to an output position.

A further object is to facilitate the shingling of upset materials, both during upset and during subsequent transport of the sheets to the output position.

A yet further object is to operate the system with a common motive source for upsetting the stack and moving the conveyors.

A still further object of the invention is to control the throughput of the system to insure a continuous and adequate supply of material at the system output.

SUMMARY OF THE INVENTION

In accomplishing the foregoing and related objects, the invention provides for conveying a stack of materials to a prescribed position, and changing the orientation of the conveyors and the stack at the prescribed position.

In accordance with one aspect of the invention, the conveyors are reorientable relative to one another at a common position. This permits the conveyors to be used directly for upset and eliminates the need for auxiliary slats to serve as a backrest. This also permits upset of the stack without elevating it above its position of receipt.

In accordance with a further aspect of the invention the conveyor that serves as a backrest during upset is reversible to facilitate the shingling separation of the sheets and avoid the adverse weight effects of the sheets that could occur if the backrest were to remain stationary.

In accordance with still another aspect of the invention, hydraulic circuitry is used to both operate the conveyors and provide the lift for members used to upsetting the stack. This eliminates the need for electric motors with high reduction gear ratios to provide the desired torque for system operation.

In accordance with an additional aspect of the invention, at least two of the conveyors can be pivotally connected and adopt a coplanar configuration. This permits the upset to take place with respect to a horizontal plan, by contrast with the inclined planes, and the attendant difficulties they cause, of the prior art.

In accordance with a further aspect of the invention, a retractable horizontal output conveyor is employed which provides a continuous extension for a shingling conveyor and avoids the kind of abrupt change in incline which can interfere with output feed.

DESCRIPTION OF THE DRAWINGS

Other aspects of the invention will become apparent after considering several illustrative embodiments taken in conjunction with the drawings in which:

FIGS. 3A through 3D are a set of views illustrating the operation of the conveyors of FIG. 2, in which FIG. 3A shows the backrest conveyor elevated, FIG. 3B shows the upset and backrest conveyors tilted, FIG. 3C shows the backrest conveyor providing an initial shingle for a stack, and FIG. 3D shows feed of an upset stack to a shingling conveyor;

FIGS. 7A through 7C are a simplified set of diagrams showing electrical connections for the hydraulic units of the systems of FIGS. 3 and 4, in which FIG. 7A is a connection diagram for control relays, FIG. 7B is a connection diagram for the hydraulic cylinder control solenoids and FIG. 7C is a connection diagram for the motor control solenoids;

FIGS. 8A through 8D are a detailed set of diagrams corresponding generally to FIG. 7, in which FIG. 8A shows control relays, FIGS. 8B and 8C show hydraulic control solenoids, and FIG. 8D shows electric motor and control circuitry;

FIGS. 9A through 9F are a set of graphs illustrating the operation of the system of FIGS. 3 and 4, in which FIGS. 9A and 9B illustrate the elevation of the backrest and upset conveyors, and FIGS. 9C through 9F illustrate the various speeds, over time, of the backrest, upset, shingling and output conveyors;

DETAILED DESCRIPTION

Figure 1:
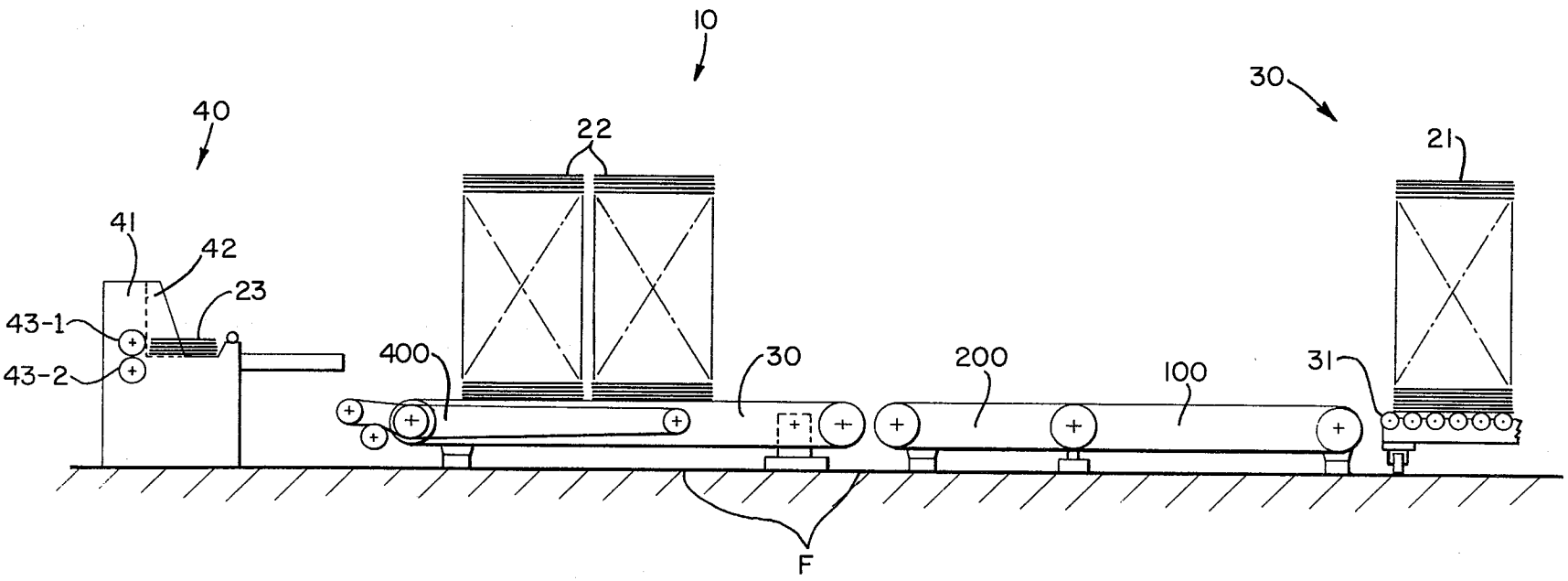
FIG. 1 is side view of a system in accordance with the invention, with its constituent conveyors in a horizontal position to permit direct feed of materials from an input location to an output location.

Turning to the drawings, a transport system 10 in accordance with the invention is shown in one of its possible configurations in FIG. 1. This configuration applies when it is desired to use the system 10 for the thru-feed of materials, such as the feed of illustrative stacks 21 and 22 shown in FIG. 1 of corrugated sheets, from a receiving or input position 30 to a sending or output position 40.

The system 10 is formed by successive conveyors 100, 200, 300 and 400. The first two conveyors 100 and 200 are tiltable and capable of automatic feed of the input stock. The third conveyor 300 is also capable of automatic feed and is associated with an output conveyor 400 which is shown with its belts in a retracted position.

The input position 30 includes a manual, roller conveyor 31 on which the stacks are initially placed and are thereafter moved onto the conveyor system 10 to be transported to the output position 40 for either manual or, as described below, the automatic loading of the stacks on an output instrumentality such as a feed unit 41 at the output position 40.

The feed unit 41 is thereafter used to feed a device such as a printer (not shown) which imprints the transported sheets in the manner desired. For that purpose the feed unit 41 includes a hopper 42 which is loaded manually or automatically with sheets 23 of material from the stacks 21 and 22. The sheets 23 are subsequently fed from the hopper 42 into pinch rollers such as 43-1 and 43-2 and then out of the unit 41.

It is to be noted that with the conveyors 100 through 400 positioned horizontally as shown in FIG. 1, their associated drive motors (not shown in FIG. 1) may be operated to provide automatic transport of the stacks 21 and 22 from the input position 30 to the output position 40. In addition, if the conveyors 100 through 400 are not operated automatically, the stacks may be moved manually from the input position 30 to the feed position 40 by being pushed over the horizontally extended conveyor system 10. Thus the system 10 is directly usable even if temporary shut down is required, for example, for the repair of a particular component.

In general, however, the invention contemplates the use of the system 10 for the automatic loading of the instrumentality 41. This is accomplished by the feed of the stacks over the initial conveyors 100 and 200, and by using them to reorient the stacks, followed by feed over the third conveyor 300, in an upwardly pivoted position, and final feeding to the hopper 42 by the belt conveyor 400, in its generally horizontal extended position.

Figure 2:
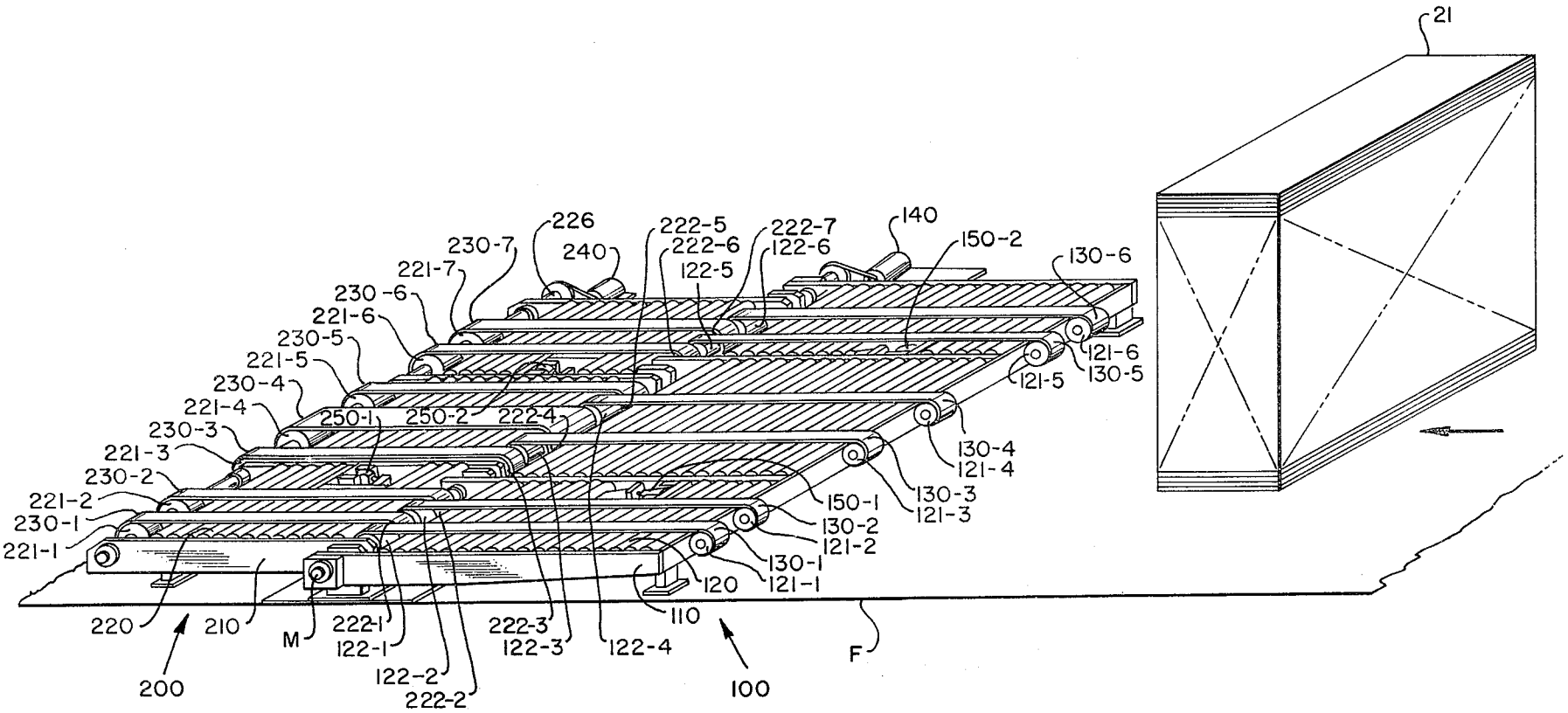
FIG. 2 is a perspective view of the backrest and upset conveyors of the system of FIG. 1.
Figure 3A:
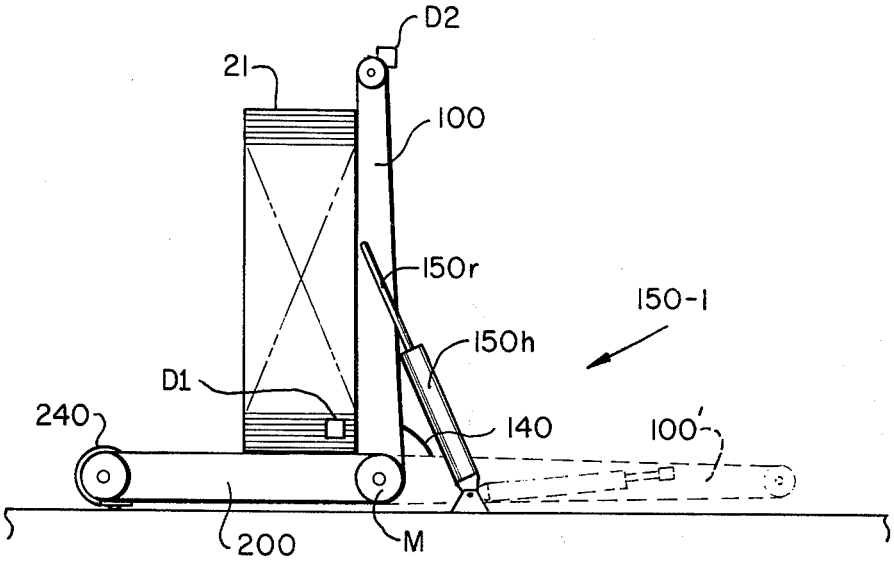
Figure 3B:
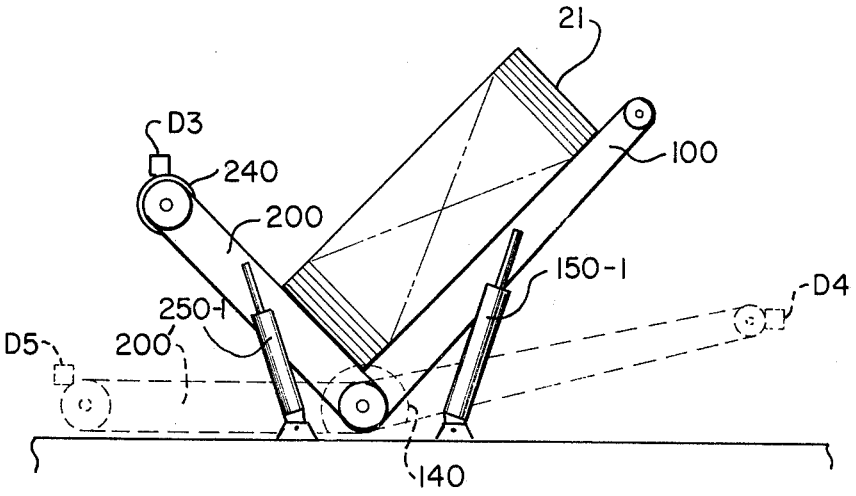
Figure 3C:
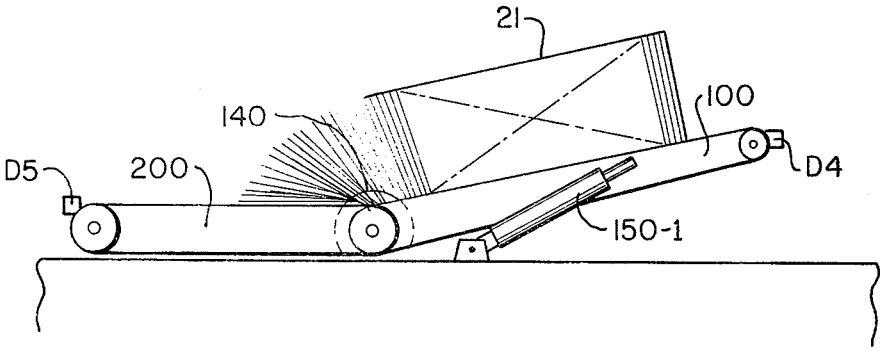
Figure 3D:
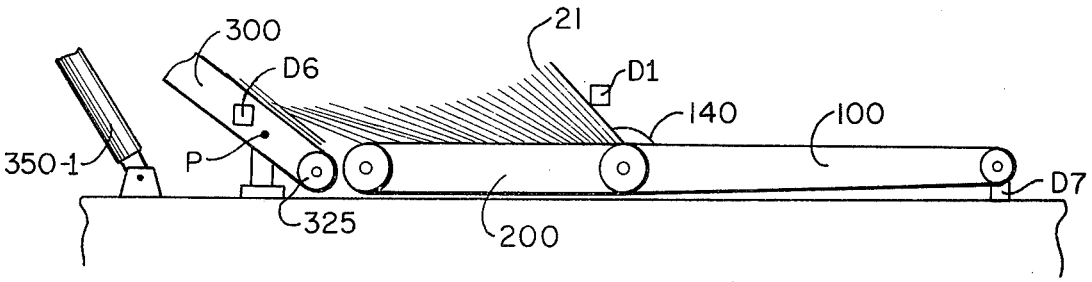
Figure 4:
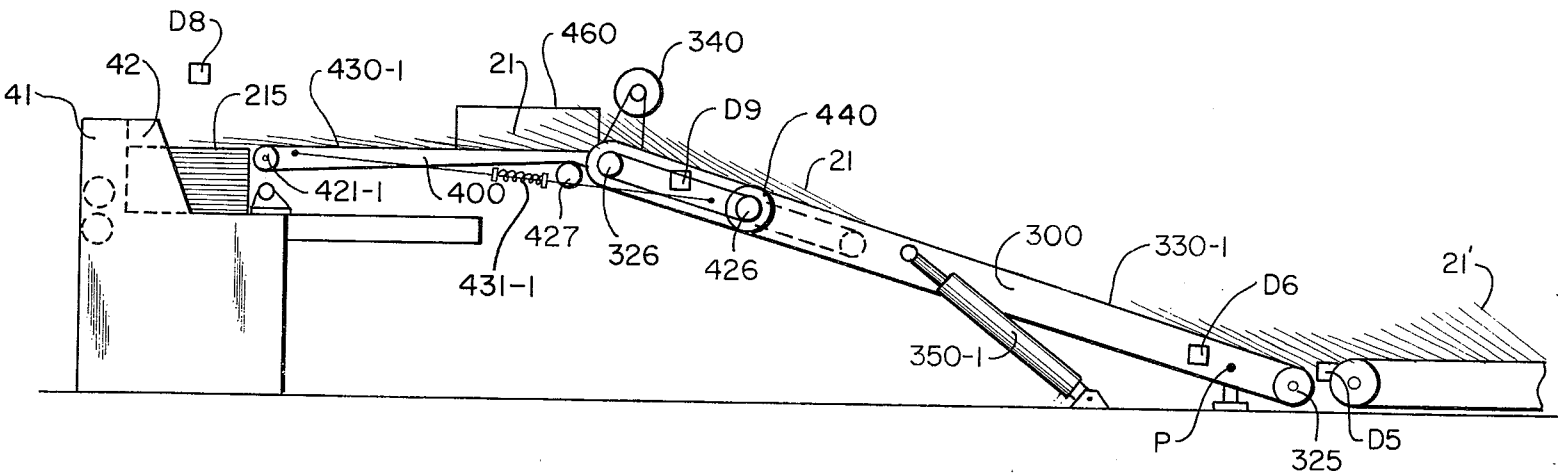
FIG. 4 is a side view of output constituents for the system of FIG. 1, including shingling and output conveyors and an output unit.
Figure 5:
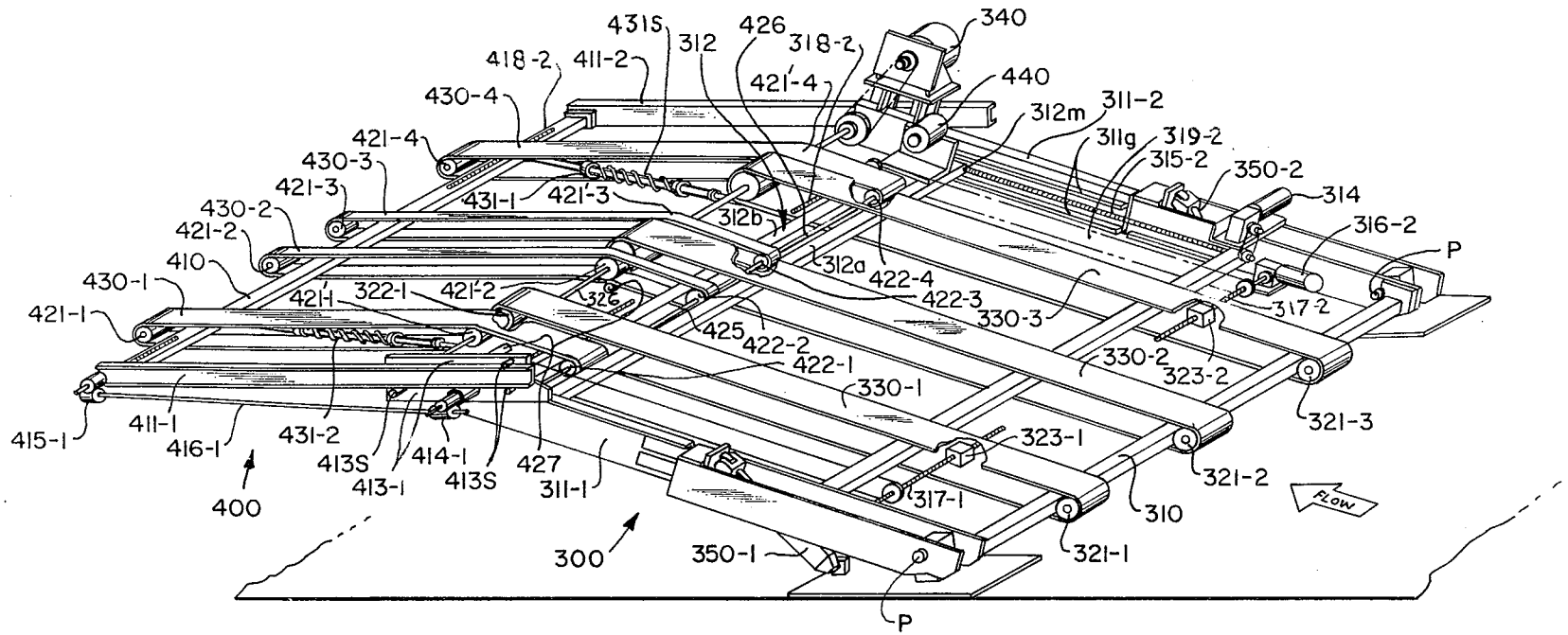
FIG. 5 is a perspective view of the shingling and output conveyors of FIG. 4.

The first two conveyors 100 and 200 are illustrated in FIG. 2, and their operation is illustrated by FIG. 3, while the operations of the remaining conveyors 300 and 400 are considered in conjunction with FIGS. 4 and 5.

Details of the first two conveyors 100 and 200 are set forth in the perspective view of FIG. 2. The conveyors 100 and 200 include respective frames 110 and 210 which are jointly pivoted at a central main shaft M. The frames may be separately pivoted.

Installed in the frames 110 and 210 are respective sets of rolls 120 and 220. Surrounding the rolls 120 of the frame 110 are drive belts 130-1 through 130-6. The drive belts are supported by idler pulleys 121-1 through 121-6 at one side of the frame 110 and by drive pulleys 122-1 through 122-6 secured to the main shaft M at the opposite side of the frame 110. For simplicity, the idler pulleys 121-1 through 121-6 are shown without the brackets and shafts by which they are mounted on the frame 110 in conventional fashion.

Similarly the frame 210 includes drive belts 230-1 through 230-7 supported by drive pulleys 221-1 through 221-7 on a shaft 226 on one side, and by free running pulleys 222-1 through 222-7 on the main shaft M.

The belts 130-1 through 130-6 are driven by a hydraulic motor 140, while the other belts 230-1 through 230-7 are driven by a hydraulic motor 240. In addition the frame 110 can be pivoted upwardly about the main shaft M, as described below, by hydraulic cylinders 150-1 and 150-2. Similar hydraulic cylinders 250-1 and 250-2 are used for the other frame 210.

The illustrative incoming stack 21 in FIG. 2 is reoriented by the operation of the pivotable conveyors 100 and 200 in the manner illustrated by FIG. 3, in constituent FIGS. 3A through 3D.

As shown in FIG. 2, the conveyors 100 and 200 are initially coplanar and extend horizontally with respect to the support surface such as the floor F. In their horizontal positions the belts 130-1 through 130-6 of the conveyor 100 are operated by the motor 140 through the shaft M. Simultaneously the belts 230-1 through 230-7 of the conveyor 200 are operated by the motor 240 through the shaft 226. A stack of materials, such as the stack 21 shown in FIG. 2, is then moved to the first conveyor 100. The moving belts of the conveyors 100 and 200 cause the stack 21 to be transported completely over the first conveyor 100 and on to the second conveyor 200 until the trailing edge of the stack has cleared the pivot position of the first conveyor 100 about the main pivot shaft M.

Once the stack 21 is in the desired position, as shown in FIG. 3A, a detector D1 such as a photoelectric cell or other suitable type of switch causes the motors 140 and 240 of the respective conveyors 100 and 200 to come to a stop. After a short and suitable delay interval, the hydraulic cylinders 150-1 and 150-2 of the first conveyor 100 (with only cylinder 150-1 visible in FIG. 3A) are operated to pivot the conveyor 100 about the main shaft M, raising it from its phantom position $100^1$ to the substantially vertical position shown in FIG. 3A. At that point a second detector D2, such as a switch, is operated to initiate elevation of the second conveyor 200 by its hydraulic cylinders 250-1 and 250-2.

As the second conveyor 200 is being elevated, the first conveyor is being lowered, with the hydraulic system for the two conveyors being locked hydraulically to insure simultaneous movement of the two conveyors 100 and 200 until the second conveyor 200 reaches the stack upset position shown in FIG. 3B. Illustratively the stack upset position is at an angle of 50 degrees of the second conveyor with respect to its rest position $200^1$. At that point the second conveyor 200 actuates a detector D3, such as a switch, to initiate the return of the upset conveyor 200 to its rest position $200^1$. Simultaneously the backrest conveyor 100 descends to the position shown in FIG. 3C.

When the switch D3 is tripped by the upset conveyor 200 this action also causes the motor 140 of the backrest conveyor 100 to operate in a reverse direction in order to facilitate reverse shingling, i.e. separation, of the members of the stack as shown in FIG. 3C. The backrest conveyor 100 remains in its elevated position, illustratively with an angle of elevation of approximately 20 degrees during subsequent automatic feeding of the members of the stack to the hopper 42 of the output unit 41 (FIG. 4). After the members of the stack 21 have cleared the detector D1, as shown in FIG. 3D, the backrest conveyor 100 is returned to its initial position in preparation for the transport of the next stack to the upset position.

The automatic feed to take place from the second conveyor 200 to the hopper 42, the third conveyor 300 of FIG. 1 and its associated, retracted conveyor 400 are oriented as shown in FIG. 4.

The third conveyor 300 is generally similar in configuration to the second conveyor 200 and includes a pivot P at one end of the frame and an associated drive motor 340, a set of drive belts, of which one such belt 330-1 is visible in FIG. 4, and a pair of hydraulic cylinders for elevating the shingling conveyor 300; of which one of the cylinders 350-1 is visible in FIG. 4.

The fourth or horizontal feed conveyor 400 is formed by a set of retractable belts, of which one belt 430-1 is visible in FIG. 4. A drive shaft 426 nested within the third conveyor frame is motorized by a drive motor 440. The other end of the belt 430-1 is wrapped around an idler pulley 421-1. The drive shaft 426 is moveable within the frame of the third or shingling conveyor 300 by a spring loaded rods, of which one rod 431-1 is visible in FIG. 4.

The fourth conveyor 400 also includes an idler shaft 427 and an oscillatory paddle 460 for aligning the sheets that are being fed automatically to the hopper 42 of the feed unit 41.

The hydraulic cylinders 350 of the third conveyor 300 are actuated to raise the conveyor to its shingling position as shown in FIG. 4, and the fourth conveyor 400 is extended to the hopper feed position of the output unit 41.

Details of the third and fourth conveyors 300 and 400 are set forth in the perspective view of FIG. 5.

The support structure of the conveyor 300 is a frame 310 with side arms 311-1 and 311-2. The outward end of the frame 310 includes a cross bar assembly 312 with individual members 312a and 312*b* that are joined to mounting plates 312*m*. The latter are slidable along a path defined by guide rails 311*g*, of which only the guide rail of the remote arm 311-2 is visible in FIG. 5.

The support structure of the output conveyor 400 is a frame 410 with side arms 411-1 and 411-2, which are slidable with respect to mounting plates 413-1 and 413-2. The latter are pivotally mounted on respective side arms 311-1 and 311-2 of the third conveyor frame 310.

Included at the end of the frame 310 near the output conveyor 400 is a drive shaft 326 for drive belts 330-1 through 330-3. The belts are supported by drive pulleys 322-1 through 322-3 on the drive shaft 326 and by idler pulleys 321-1 through 321-3 at the other end of the frame 310.

In the case of the frame 410 drive belts 430-1 through 430-4 are supported by idler pulleys 421-1 through 421-4 at the output end of the frame 410, and by a second set of idler pulleys $421^1$-1 through $421^1$-4 on the drive shaft 326 of the third conveyor 300. The drive belts 430-1 through 430-4 of the output conveyor 400 are driven by pulleys 422-1 through 422-4 on a drive shaft 415 positioned between the individual members 312*a* and 312*b* of the moveable arm assembly 312 of the third conveyor 300.

In the case of both frames 310 and 410, the support structure for the idler pulleys 321-1 through 321-3, and 421-1 through 421-4, at the ends of the frames, has been omitted for simplicity, but it will be understood that conventional brackets and shafts are used to mount the pulleys on their respective frames in standard fashion.

Motive power for the third conveyor 300 is provided by a hydraulic drive motor 340 which is coupled to the drive shaft 326; while motive power for the output conveyor 400 is supplied by a drive motor 440 mounted in the arm assembly 312.

The third conveyor 300 is elevated and lowered by hydraulic cylinders 350-1 and 350-2, and the output conveyor 400 is retracted with respect to the third conveyor.

The retraction of the output conveyor 400 is accomplished using a gear head motor 314 which is mounted on the arm 311 of the third conveyor 300 near the second cylinder 350-2 as shown in FIG. 5.

The gear head motor 314 operates a pair of carriage lead screws 315, (of which only the second screw 315-2 is shown in FIG. 5) that is threaded into the second arm 312*a* of the arm assembly 312. As the gear head motor 314 operates it draws the arm assembly 312 toward the input end of the third conveyor 300 by causing the mounting plates 312*m* to move within the confines of the guide rails 312*g*.

The gear head motor 314 has a suitable gear reduction built into it and operates in well known fashion through a torque limiter to eliminate the need for separate limit switches.

As the arm assembly 312 is retracted, the side arms 411-1 and 412-2 of the output conveyor 400 are simultaneously retracted with respect to the horizontal arm support rolls 413*s* of the pivotable support plate 413.

The desired tension in the belts 430-1 through 430-4 is maintained by spring loaded tie rods 431-1 and 431-2. Each of the tie rods 431 is formed by rods 431*a* and 431*b* that are separated by a compression spring 431s. Slack in the belts 430-1 through 430-4 is prevented by a wrap roller 427, which may take the form of individual segments for the individual belts, near the drive shaft 326 of the third conveyor 300.

The third conveyor includes additional gear head motors 316, of which only the remote motor 316-2 is shown, for adjusting the spacings of the outer belts 330-1 and 330-3. The desired adjustments are effected by lead screws 317 and 318, formed by a screw 317-1 coupled by a drive chain 319-1 to a screw 318-1 and by a screw 317-2 coupled by a drive chain 319-2 to a screw 318-2. Each of the lead screws 317 and 318 includes a respective coupling members (which acts as a nut) 323 and 324 that are connected in conventional fashion (not shown) for side to side movement of the associated belts 321-1 and 321-3.

In addition the upper lead screws 318 are coupled to similar lead screws 418 of the fourth conveyor 400 by floating gear boxes 414 and 415 through a keyed shaft 416, of which only the near side gear boxes 414-1 and 415-1, and the near side shaft 416-1, are shown in FIG. 5. The floating gear boxes 414 and 415 are illustratively of the type manufactured by the Tol-O-Matic Company of Minneapolis, Minn., under the trade name Tol-O-Matic model RH-0220. Such gear boxes allow the keyed shafts 416 to move back and fourth without binding effect during the telescoping operation of the output conveyor 400.

In operation of the entire system 10, the motors 340 and 440 of the shingling and output conveyors 300 and 400 are actuated when the stack 21 is initially moved on the first conveyor 100. After the stack 21 has been reoriented by the action of the backrest and upset conveyors 100 and 200 as shown in FIG. 3C, the forward motion of the conveyor belts carries the sheets that have been shingled by the reverse direction operation of the backrest conveyor 100, to the shingling conveyor 300. When the last sheet from the stack 21 has passed from the upset conveyor 200, that occurrence is sensed by a detector D6, such as a switch, at the input end of the shingling conveyor. This has an effect on subsequent stacks as described below.

When the first sheet leaves the shingling conveyor 300, it actuates a switch D9 that changes the speed of the drive motor 340 in preparation for the loading of single sheets in the hopper 42. When the sheets being loaded in the hopper 42 reach the nominal level, detector D8, which is illustratively of the reflective photocell type, manufactured, for example, by the Micro-Switch-Farmer Electric Division of the Honeywell Company, Natik, Mass., the light transmitted to the photocell receiver is increased and consequently changes the output voltage level. The latter is used to control the speed of the various system motors in the manner described below to assure that the automatic feed to the hopper 42 is appropriately controlled. In effect, the photocell sensor D8 operates to maintain the level of sheets in the feed hopper substantially at a constant level. In the equilibrium condition the sheets that enter the hopper do so at substantially the same rate as they leave.

It will be apparent that the detector D8 may be implemented in other ways, for example, by the use of a weight sensitive indicator which produces an output voltage, after a threshold is reached, in proportion to the weight of the sheets in the hopper. Alternatively, the detector D8 may take the form of a unit positioned above the stack in the hopper to measure the amount of time it takes for a sound beam to be transmitted and bounce back from the top of the stack. As the stack height increases, the bounce time decreases and is translated into a voltage swing which causes a speed change of the conveyor drive motors.

Figure 6A:
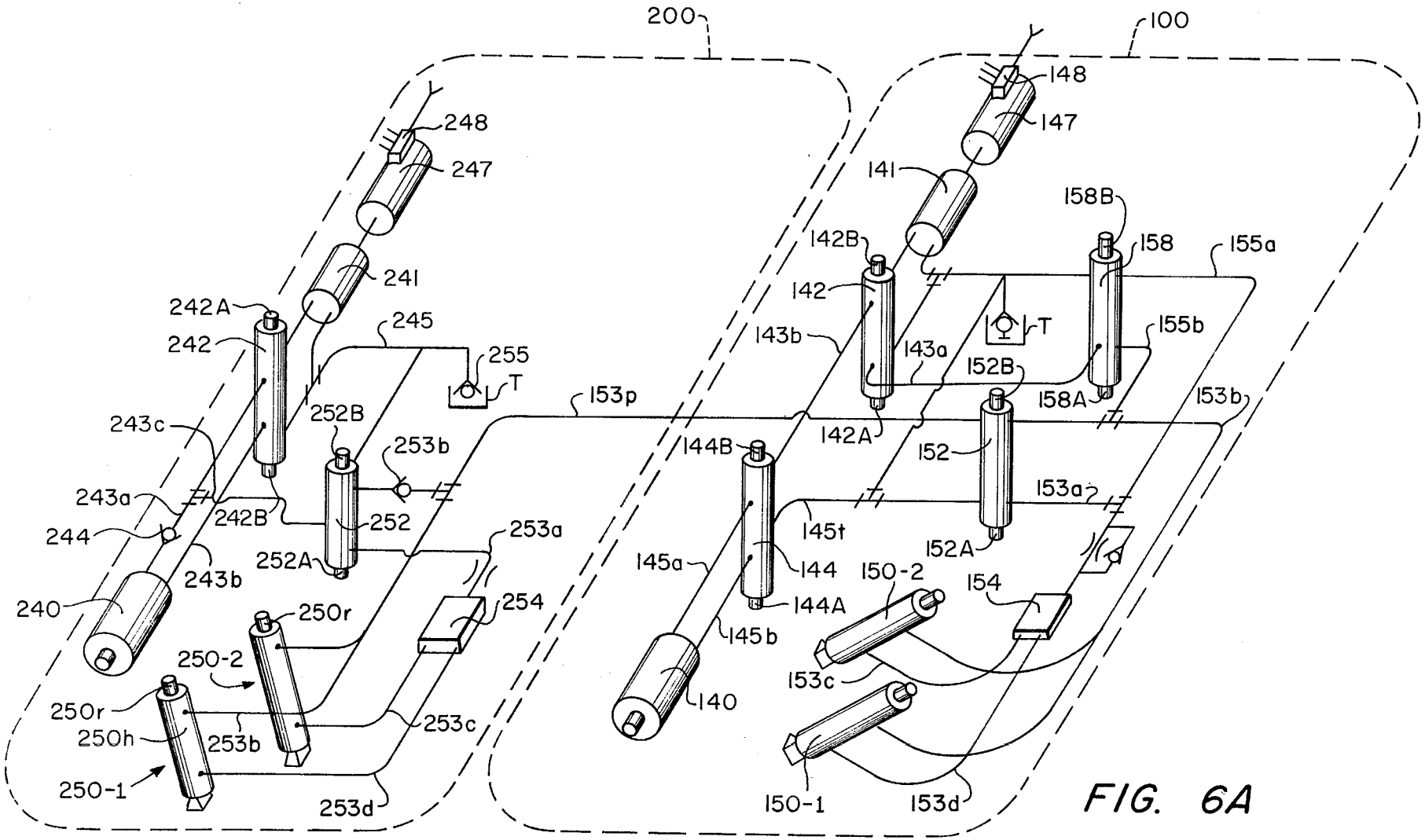
FIGS. 6A and 6B are respective perspective and connection diagrams for the hydraulic circuitry of FIGS. 2 and 5.
Figure 6B:
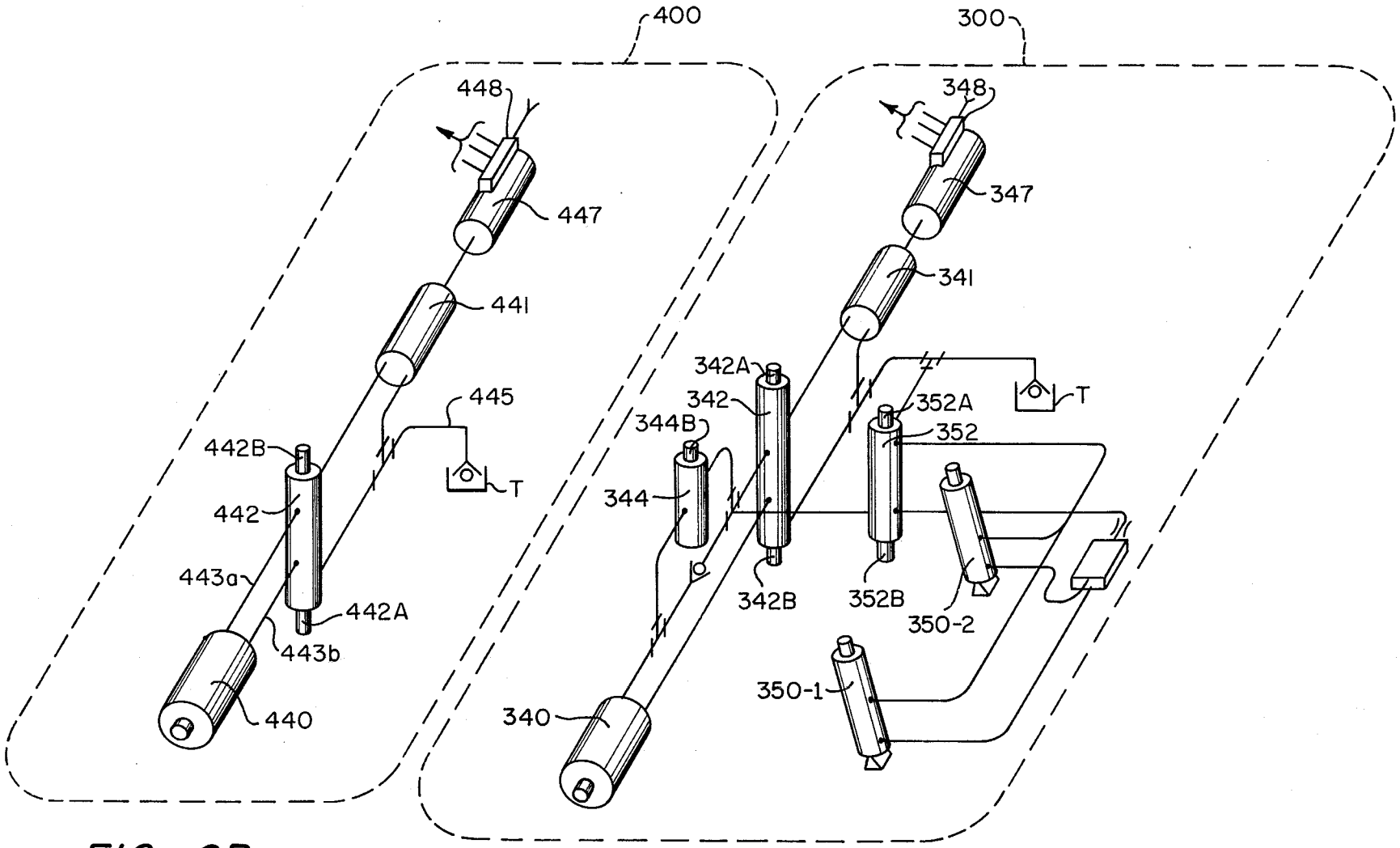

The hydraulic circuitry for controlling the system 10 of FIGS. 1 – 4 is illustrated in FIGS. 6A and 6B.

As shown in FIG. 6A, the motors 140 and 240 for the respective conveyors 100 and 200 are operated from respective pumps 141 and 241 through proportional control valves 142 and 242. In addition, the backrest conveyor motor 140 is operable through a switch valve 144. The pumps 141 and 241 are driven by three phase motors 147 and 247, with respective starters 148 and 248.

The proportional control valves 142 and 242 cause fluid to appear on lines 143*b* and 243*b* in proportion to the magnitude of the voltage applied to control terminals 142B and 242B. Similarly, a proportional flow of fluid appears on lines such as 143*a* or 243*a* according to the voltage applied to control terminal 142A or 242A.

The directional valve 144 produces flow from line 143*b* to line 145*a*, and consequently from line 145*b* to line 145*t*, when solenoid 144B is energized, and a cross flow, e.g. to line 145*b* from line 143*b* and a return from line 145*a* to line 145*t*, when solenoid 144A is energized. This has the effect of reversing the operation of the motor 140 at a speed governed by the magnitude of the signal applied to valve 142.

A hydraulic system similar to that used for the upset conveyor 200 is used to operate the third and fourth conveyors 300 and 400, with pumps 341 and 441 operated in conjunction with proportional control valves 342 and 442.

Each of the pump units 141, 241, 341 and 441 is advantageously formed by a pump motor component and a variable volume pump. Representative pump motors are 7½ horsepower Brown and Sharpe motors for units 141 through 341 and a 2 horsepower T-10 Varipak motor for unit 441, combined with a variable volume pump to produce hydraulic flow ranging from 10 to 0.2 gallons per minute. The hydraulic motors are advantageously of the Charlynn 4000 designation for units 140, 240 and 440, and of the Staffa B-30 designation for unit 340.

For the particular hydraulic circuitry of FIG. 6A, in addition to operation of the conveyor motors 140 and 240, there is also operation of the hydraulic cylinders 150-1 and 2 of the first conveyor 100, in synchronism with the hydraulic cylinders 250-1 and 2 of the second conveyor 200. For that purpose, a directional valve 252 is used with cylinders 250-1 and 2 and operated from the proportional valve 242.

When the solenoid 242A of the proportional valve 242 is operated, fluid is diverted from the motor 240 to the directional valve 252 over the line 243*c*. The latter directional valve causes fluid to appear on output line 253*b* or 253*a* according to whether solenoid 252B or 252A is activated.

Thus when solenoid 252B is operated, fluid appears on output line 253*b* to lower the cylinders 250-1 and 2. Conversly when solenoid 252A is actuated, fluid initially appears on line 253*a*, and then at a flow divider 254, which assures relatively equal distribution of fluid between cylinders 250-1 and 2, forcing their rods 250r into an elevated position.

As can be seen in FIG. 6A, the hydraulic circuitry associated with the upset conveyor motor 240, and its hydraulic cylinders 250-1 and 2, is tied to the circuitry associated with the backrest conveyor motor 140, and its associated cylinders 150-1 and 2, by a connecting line 153*p* to a directional valve 152. This allows fluid from the upset conveyor pump to be combined with fluid from the backrest conveyor pump 141, by way of a directional valve 158 that is connected to the proportional valve 142 by a line 143*a*.

Hence the directional valves 152 and 158 are able to act jointly (by fluid on lines 153*a* and 155*a* through a divider 154) to raise the backrest conveyor cylinders 150-1 and 2. In a shorter time, conversely the cylinders are lowered by fluid on lines 153*b*.

It is to be noted that the cylinders 150-1 and 2 and 250-1 and 2, have their elements hydraulically locked together to provide for relatively synchronous movement on the upstroke of the cylinder 250-1 and 2 as shown in FIG. 3B. For that purpose, in an illustrative embodiment of the invention, the rods of the backrest cylinders 150-1 and 2 have a diameter of about 2 inches, a maximum stroke of about 26 inches, and an inside cylinder diameter of about 3.25 inches. It has been determined that for such dimensions upset cylinders of similar inside diameter can have a rod diameter of about 1.375 inches. With such dimensions the angular position (included angle) of the backrest conveyor 100 relative to the upset conveyor 200 can be maintained in the range from 91¼ degrees to 92¼ degrees when the angle of the backrest conveyor relative to the horizontal ranges from 88° to 37¾°; and the angle of the upset conveyor through 50°. The stroke ratio of the rods (small to large) is 6.81/5.15 equal about 1.32.

Hydraulic circuitry similar to that of FIG. 6A is shown in FIG. 6B for the conveyors 300 and 400. Operations are similar to that described previously except that motor 340 has a bypass, solenoid operated valve 344, the purpose and operation of which is explained below.

Figure 7A:
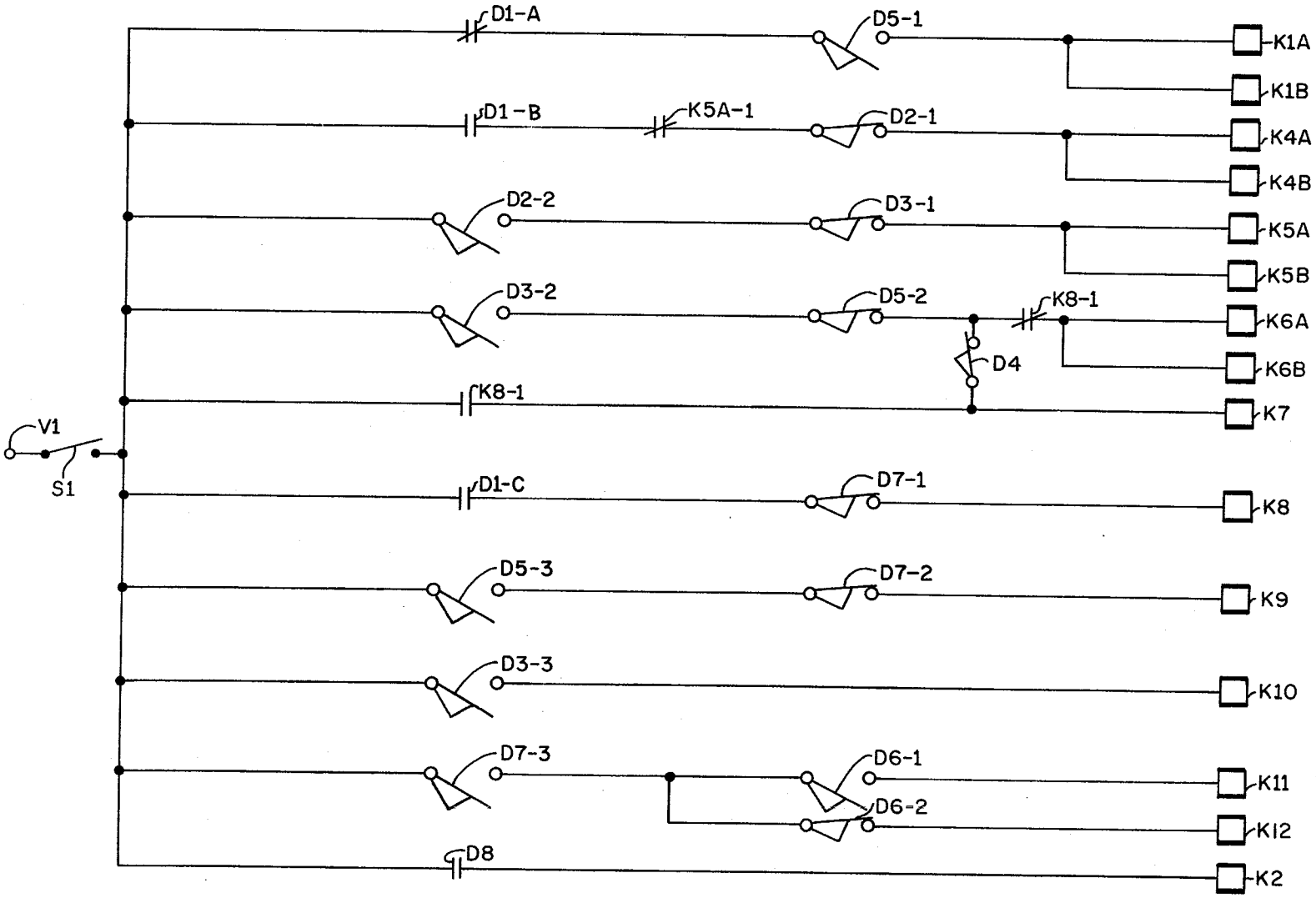
Figure 7B:
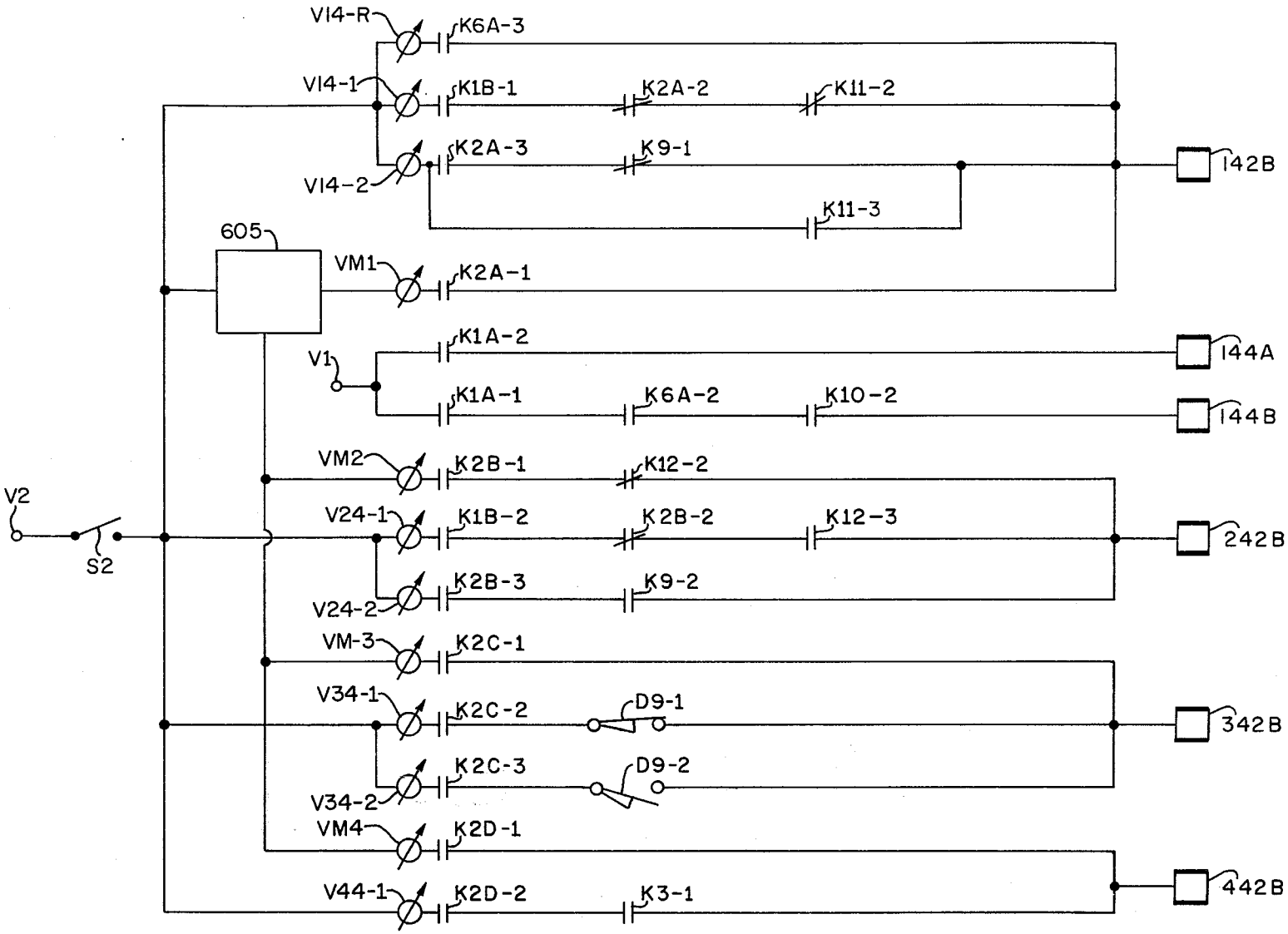
Figure 7C:
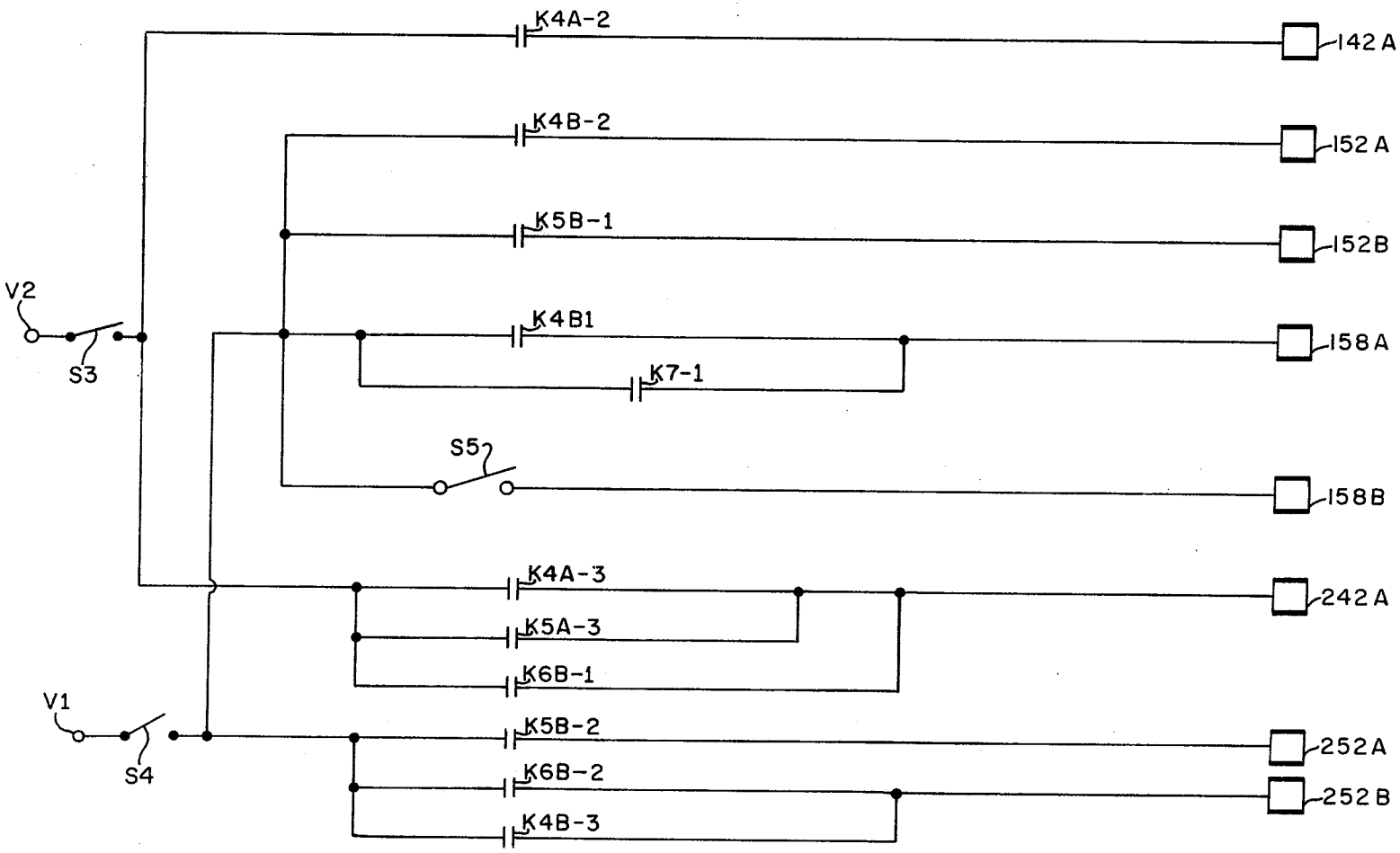

Illustrative electrical control circuitry is shown in FIGS. 7 and 8. The circuitry of FIG. 7, consisting of FIGS. 7A through 7C, is a simplification, to facilitate understanding, of the detailed circuitry of FIG. 8, which brings about the results pictured in the graphs of FIGS. 9A and 9B.

In FIGS. 7 and 8, normally open contacts are depicted in accordance with industry convention by parallel lines at right angles to a lead line. Each of the parallel lines represents one of a pair of contacts that are brought together when their associated coil is energized. A diagonal slash through the contacts indicates that they are normally closed, and are held open as long as their associated coil is energized.

Mechanical detector switches shown in FIGS. 7 and 8, are also normally open or normally closed according to whether the switches are initially in their open or closed positions. At certain positions, the mechanical detectors are formed by multiple switches, with one or more normally open and/or one or more normally closed positions. Thus the mechanical detector D2 includes a first unit D2-1 which is normally closed and a second unit D2-2 which is normally open (FIGS. 7A and 8A).

Similarly the photo detector D1 has multiple functions, opening contacts D1-A and simultaneously closing contacts D1-B when the stack reaches the upset position, and subsequently closing the contacts D1-C when the upset stack leaves the second conveyor.

In general, the relay contacts and switches of FIG. 7A operate auxiliary relays, which in turn control the motor relays of FIG. 7B and the hydraulic cylinder relays of FIG. 7C.

Figure 9A:
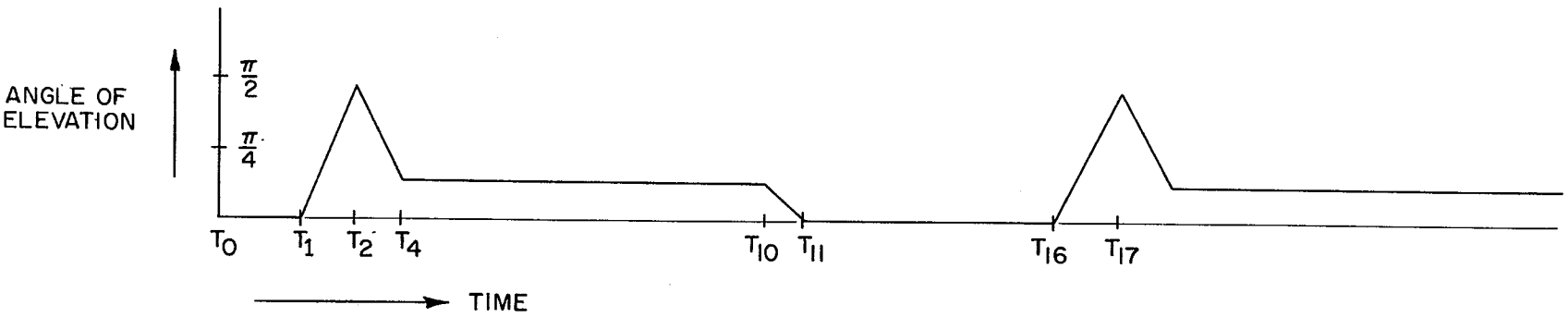

In operation, shortly after the stack has reached the position shown in FIG. 3A, e.g. about time $T_1$ in FIG. 9A, a signal from detector D1 causes closure of contacts D1-B and operates relays K4A and K4B (FIG. 7A). This in turn operates solenoids 142A, 152A 158A, 242A and 252B (FIG. 7C). Solenoid 142A provides acceleration control for proportional valve 142; while solenoid 242A does the same thing for proportional valve 242. Solenoids 252B and 152A act on valves 252 and 152 to permit fluid from pump 241 to flow to the backrest cylinders 150-1 and 2; while solenoid 154A permits a similar flow from pump 141. The result is there is a combination of fluids from two pumps, which doubles the speed of operation in elevating the backrest conveyor 100 to its vertical position shown in FIG. 3A. At the vertical position normally closed switch D2-1 of the second detector D2 open momentarily and causes the previously energized solenoids to be deenergized at time $T_3$ in FIG. 9A.

Figure 9B:
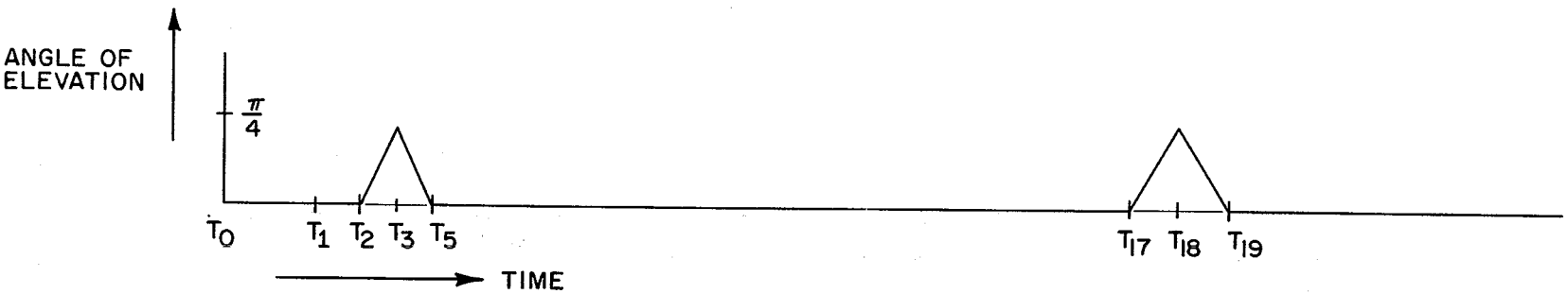

Simultaneously there is closure of the normally open switch D2-2 which operates relays K5A and K5B and energizes solenoids 152B, 242A and 252A to begin the elevation of the upset conveyor or at time $T_3$ in FIG. 9B and the corresponding lowering of the backrest conveyor. Solenoid 242A is used for acceleration control of proportional valve 242; while solenoid 252A places direction valve 252 in its "up" position and solenoid 152B places direction valve 152 in its "down" position.

The result is that as fluid is forced into the upset cylinders 250-1 and 250-2 to elevate them, corresponding fluid is forced into the backrest cylinders 150-1 and 150-2 to lower them.

When the backrest and upset conveyors reach the position shown in FIG. 3B, at time $T_4$ in FIGS. 9A and 9B, detector D3 operates and deactivates the solenoids 152B, 242A, and 252A by the momentary opening of contacts D3-1.

Simultaneously detector D3 closes contacts D3-2 for solenoids 158A, 242A and 252B. This permits the lowering of cylinders 250-1 and 2 and the gravity fall of cylinders 150-1 and 2 (through valve 158). The backrest conveyor continues its fall until it reaches detector D4 in FIG. 3B. This momentarily opens contacts D4 at time $T_5$ (FIG. 9A) and the backrest conveyor 100 is held at the D4 position.

The upset conveyor continues its fall until it again becomes horizontal at time $T_6$, when detector D5 is operated, and consequently contacts D5-3 in FIG. 7A. The conveyors 100 and 200 are then as shown in FIG. 3C.

Subsequently, when the stack clears the photo detector D1, solenoid 154B is activated at time $T_{13}$ (FIG.

9A) and the backrest conveyor is returned to its horizontal condition, actuating detector D7 and its contacts to complete the first cycle of stack reorientation as shown in FIG. 3D.

On the next cycle, at times $T_{16}$ through $T_{20}$ in FIGS. 9A and 9B, the prior cycle is repeated.

Figure 8A:
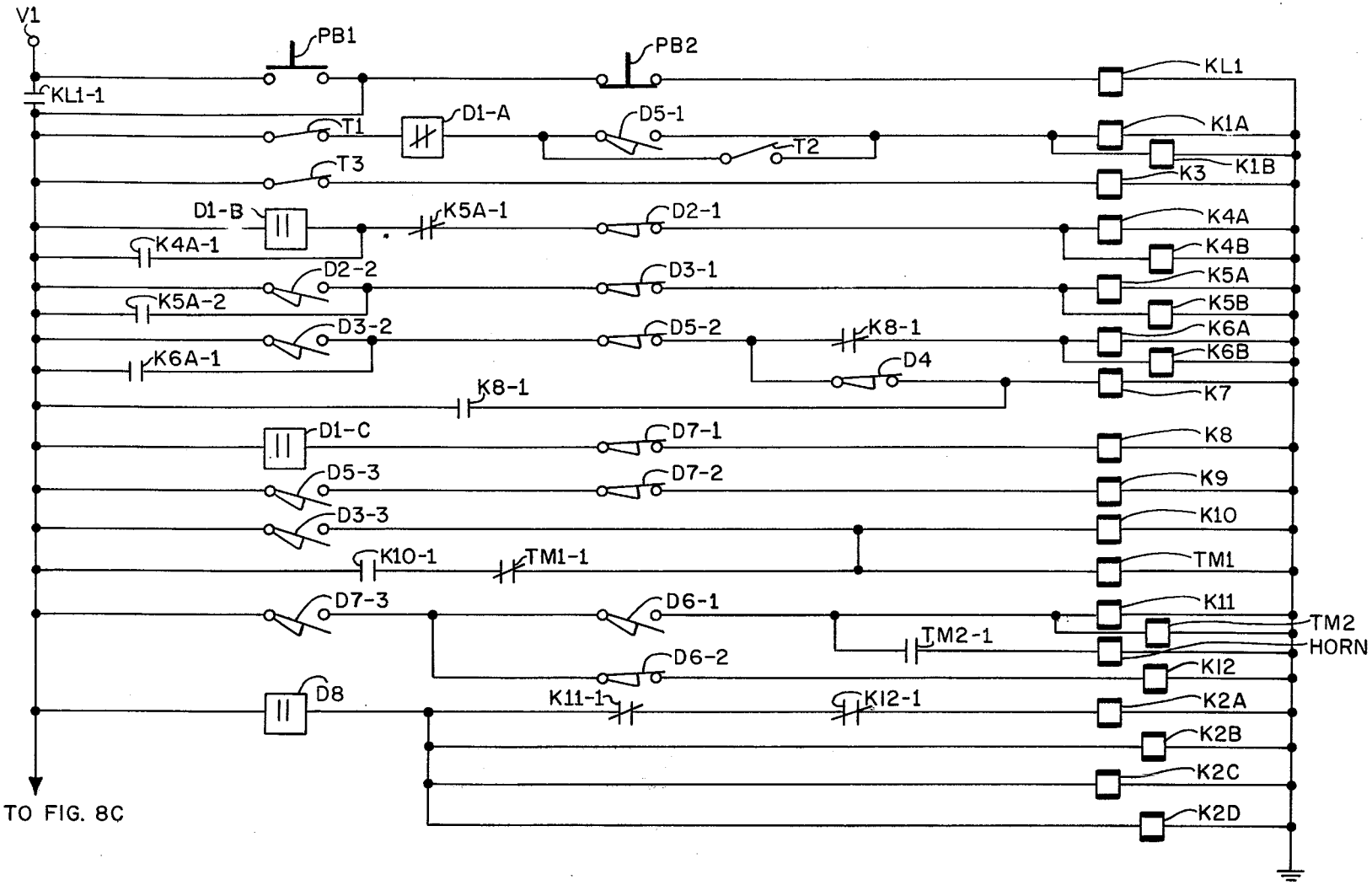
Figure 8B:
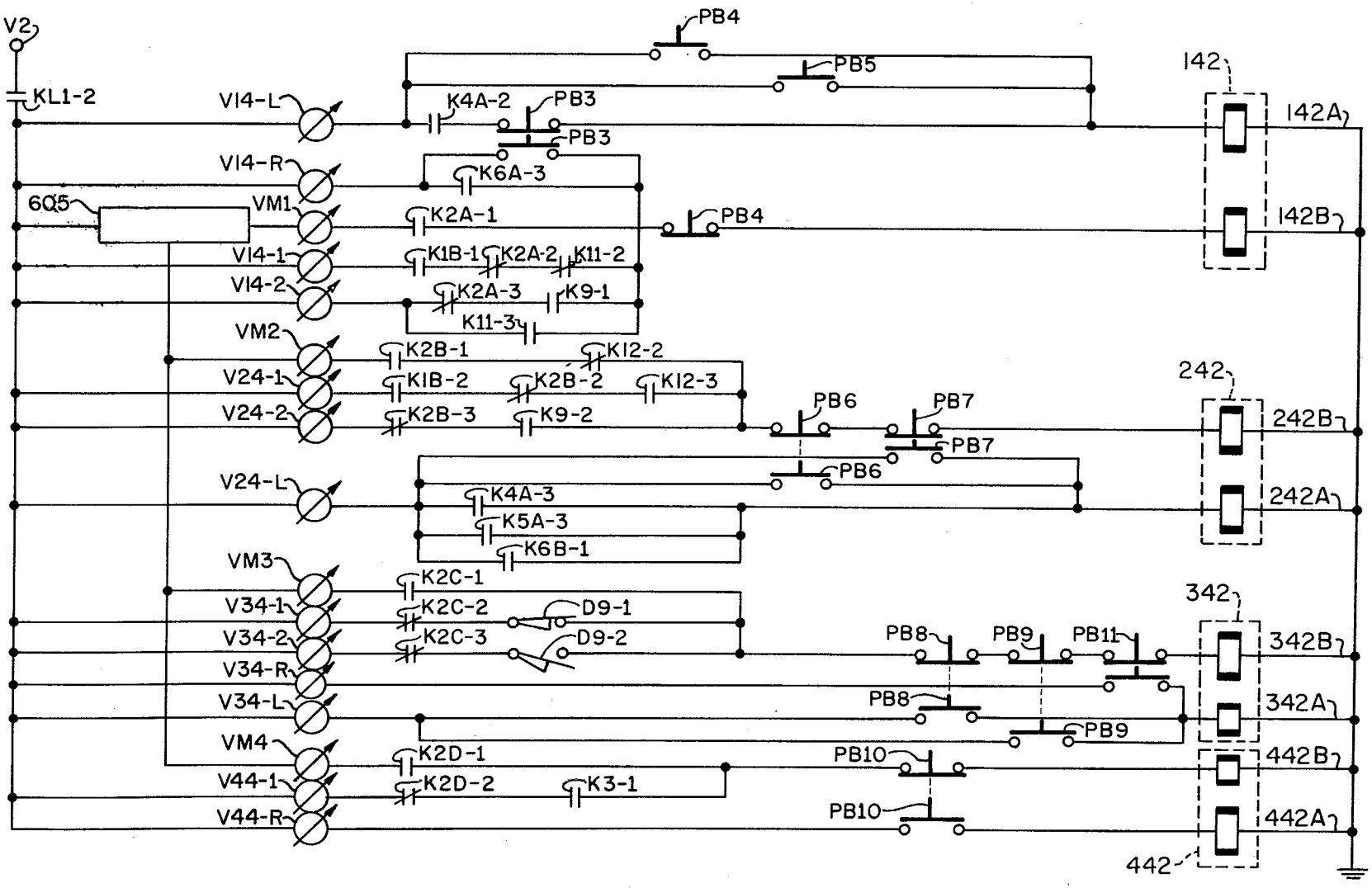
Figure 8C:
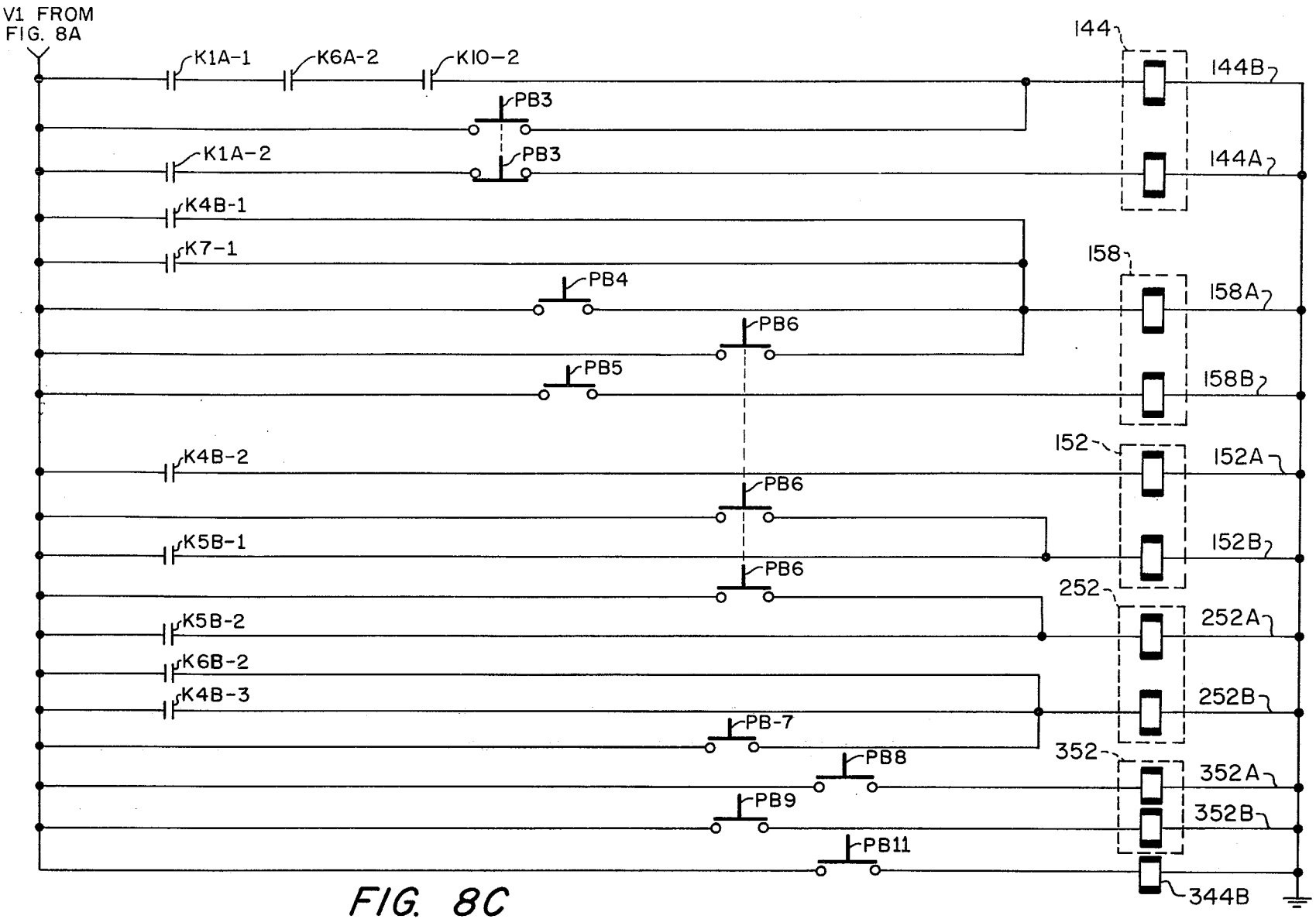

It will be understood that FIGS. 7A and 7C are a simplification of the hydraulic cylinder control circuitry shown in detail in FIGS. 8A through 8C. Thus in FIGS. 7A and 7C various manual switches S1, S3 and S4 are used to connect to various voltages V1 and V2; while in FIGS. 8A through 8C the desired connections are made by pushbutton and lockup operation.

A simplification of the control circuitry for the hydraulic motors 140, 240, 340 and 440 of the various conveyors is shown in FIG. 7B, in which various relay contacts are operated by the detector controlled relays K1 through K12 of FIG. 7A.

In the system 10, the motors 140, 240, 340 and 440 are able to operate at a variety of different speeds.

In particular motor 140 for the first conveyor 100 has two predetermined forward speeds, one predetermined reverse speed and one variable speed. The motor 240 for the second conveyor 200 also has two predetermined forward speeds and a variable speed. The motor 340 for the third conveyor 300 has similarly two predetermined forward speeds and a variable speed; finally, motor 440 of the output feed conveyor 400 has one preset forward speed and a variable speed that is controlled from the level of the sheets in the feed hopper 41 by the detector D8.

Accordingly in FIG. 7B, a source voltage V2, applied through a switch S2, is modified appropriately in the various control lines of the solenoids 142B, 242B, 342B and 442B. Thus, for solenoid 142B, a unit V14-R modifies the voltage V2 to provide a suitable preset reverse voltage, while units V14-1 and V14-2 modify the voltage V2 to provide suitable first and second preset forward voltages. Similar units V24-1 etc. appear in the lines of the other solenoids.

In addition a unit 605 that is energized by the source voltage V2, provides a modulated voltage VM under the control of the level detector D8 to the control solenoids 142B, 242B, 342B and 442B of the corresponding motors 140, 240, 340, and 440 through adjusting units VM-1, VM-2, VM-3 and VM-4.

The circuit diagram of FIG. 7B is considered in conjunction with the additional timing diagrams of FIGS. 9C through 9F. On start-up at time $T_0$, by closing switch contacts voltage is applied to solenoids 142B and 144A to cause motor 140 to operate in a forward direction at a rate $R_1$, for example 50 feet per minute. Simultaneously voltage is applied to solenoids 242B, 342B, and 442B that control motors 240, 340 and 440, causing them to being operating at their predetermined initial speeds $R_2$, $R_3$ and $R_4$, for example 50, 100 and 100 feet per minute.

Figures 9C, 9D, 9E, 9F:
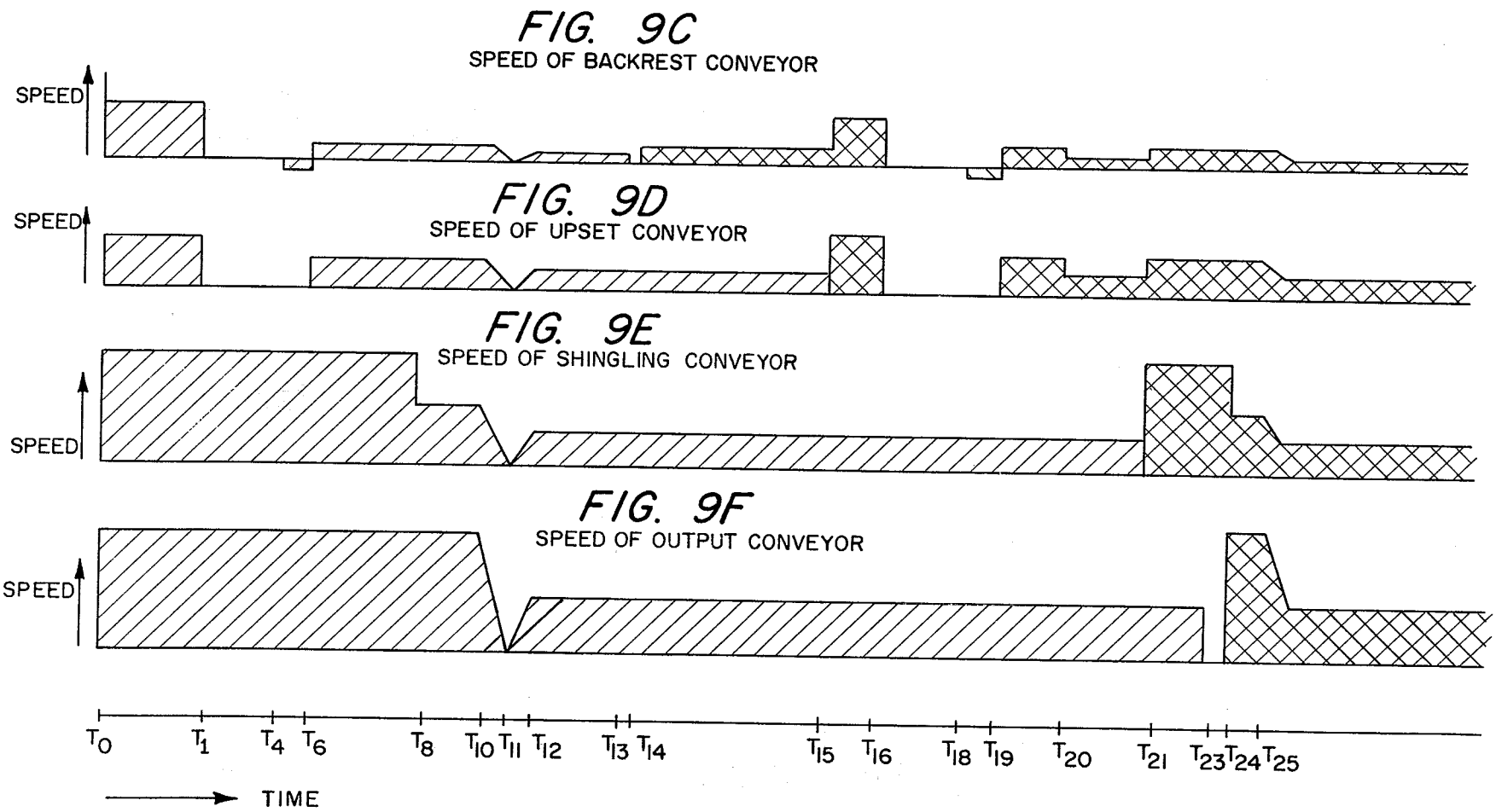

As shown in FIGS. 9C and 9D, conveyors 100 and 200 operate until the incoming stack actuates the photo detector D1, resulting in the momentary opening of the contacts D1-A (FIG. 7A) and stopping the conveyors at time $T_1$.

There is then a hiatus while the conveyors are elevated and lowered, as previously described, until the upset conveyor 200 is fully elevated at time $T_4$, actuating detector D3 and closing its associated contacts (FIG. 7A) to cause the backrest conveyor motor to reverse its direction of rotation at an illustrative speed of 10 feet per minute. This reversal helps to separate the members of the stack and produce the desired shingling effect as shown in FIG. 3C. If the stack were upset without any reverse shingling, there would be inadequate edge separation and the weight of the members on the inclined backrest surface could interfere with the further transport of the sheets to the output end of the system.

The reverse shingling continues until the upset conveyor 200 is fully lowered to the position shown in FIG. 3C at time $T_6$ and the detector D5 is activated. The latter momentarily opens contacts D5-2 in FIG. 7A, terminating the reverse operation of the motor 140. This restores the forward motion of the conveyor 100, under the control, however, of a reduced voltage, which reduces the speed, for example to 10 feet per minute, and also restores the motion of conveyor 200, but also at a reduced rate, for example 25 feet per minute, as indicated at time $T_6$ in FIGS. 9C and 9D.

The operation then continues until time $T_8$ in FIG. 9E when the first member of the stack reaches the detector D9 (FIG. 4). At that time the movement of the third conveyor 300 is reduced by the transfer operation of switches D9-1 and D9-2 (FIG. 7B). This switches the voltage of the motor solenoid 342B with an illustrative reduction in speed from 100 to 50 feet per minute. This occurs shortly before the individual sheets of the stack begin entering the hopper and is used to avoid a stack-up problem.

After the sheets enter the hopper 41 of FIG. 4 and reach the level prescribed by detector D8, the system 10 enters its modulated speed condition at time $T_{10}$ (FIGS. 9C through 9F). At that point detector D8 operates control solenoid K2 and switches the motors 140 through 440 to modulated speed operation.

As indicated previously, the modulated voltage VM, which is governed by the level of sheets in the hopper is applied appropriately to the solenoids that control the motors 140, 240, 340 and 440, for example, the voltage on the control solenoid for the fourth motor 440 may produce a rate of 36 feet per minute, the voltage on the solenoid for the third motor 340 may produce a rate of 18 feet per minute, a rate of 9 feet per minute for the second motor and a rate of 4.5 feet per minute for the first motor 140.

The initial effect of the detector D8 is to reduce the solenoid voltages to zero, and then as press feed starts, thus reducing the level in the hopper, the variable voltage increases until it reaches its predetermined levels with the results indicated in FIGS. 9C through 9F at time $T_{12}$.

Afterwards at time $T_{13}$, the reoriented stack on the first conveyor 100 passes the detector D1 and the conveyor is lowered to its initial position at time $T_{14}$.

The conveyor 100 is then ready to receive the next stack, the progress of which is indicated by the reverse hatching of the diagrams in FIGS. 9C through 9F. Although conveyor 100 is ready for the next stack, the other conveyors are still occupied by members of the first stack and the start up of the first conveyor is consequently made at a reduced rate, for example under the control of a reduced voltage producing an illustrative 10 feet per minute rate instead of the earlier start-up voltage which produced an illustrative 50 feet per minute rate. This is accomplished by the operation of detector D7 which is also desirably connected to a unit, for example a horn, which notifies workers at the input of the system 10 to push the next stack onto conveyor 100.

When the last sheet from the prior stack passes over detector D6 (FIG. 4), that indicates that the second conveyor is ready to receive the new stack and contacts are operated at time $T_{15}$ to operate both first and second conveyors until the new stack causes the photo detector to act and stop the first and second conveyors at time $T_{16}$.

The prior described reversal of the first conveyor 100 takes place from time $T_{18}$ to $T_{19}$, following which conveyors 100 and 200 are operated with respect to voltages $V_1$ and $V_2$ (also as described previously) until time $T_{20}$ when the leading edge of the new shingled input reaches detector D6 (FIG. 4), closing switch D6-1 and opening switch D6-2. This slows the first and second conveyor 100 and 200 to their previously described proportionate speeds relative to the output conveyor 400.

Subsequently when the shingling conveyor 300 has been cleared of its last sheet from the prior stack, detector D9 is operated, opening switch D9-1 and closing switch D9-2 at time $T_{21}$. This causes a speed up of conveyor 300 until the leading edge of the first sheet from the new stack acts on detector D9, at time $T_{24}$, the output conveyor 400 is empty so that it is raised to full speed, and the shingling conveyor 300 is reduced in speed.

As the output conveyor begins to load the hopper, the previously described full condition is reached and detector D8 is operated at time $T_{25}$ to return the system to its modulated speed condition and maintain the proper level of sheets in the hopper.

A detailed circuit diagram for the detector operated solenoids of FIG. 7A is shown in FIG. 8A.

Figure 8D:
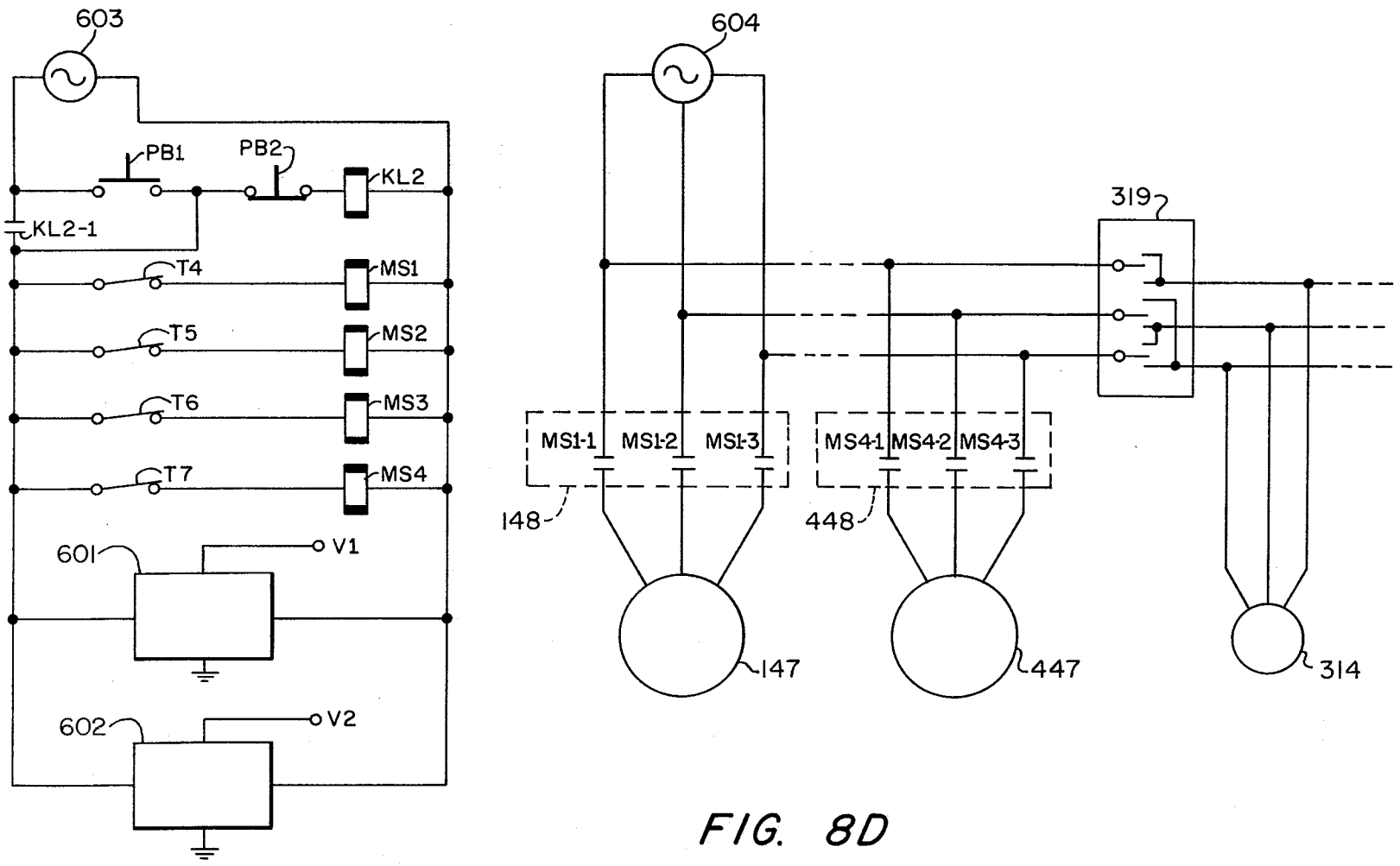

The source voltage V1 is illustratively +24 volts DC, such as that obtained in FIG. 8D from a unit 601 by transforming, rectifying and filtering the standard 110 volt 60 cycle output from a source 603.

The system 10 is placed in operation by depressing a start pushbutton PB1 which energizes relay KL1 and operates, i.e. locks-up, contacts KL1-1. As a result the system will remain in operation, i.e. locked-up, until a stop button PB2 is depressed to de-energize KL1 and open contacts KL1-1.

Similar lock-up circuitry is included for relays K4A, K5A, and K6A. Also included in FIG. 8A are manual override switches T1, T2 and T3.

In FIG. 8B, the source voltage V2 is illustratively +24 volts unfiltered DC such as provided by a transformer, rectifier 602 in FIG. 8D. Since the source voltage V2 is unfiltered it provides a dither which facilitates the operation of the hydraulic units associated with valves 142, 242, 342 and 442. In addition to the adjustable units such as V14-R, 1 and 2, and VM-1, other adjustable units V14-L, V24-L, and V34-L are included for acceleration control during the operation of associated hydraulic cylinders.

The detailed circuitry of FIG. 8B also provides for momentary pushbutton control by pushbuttons PB3 through PB11.

The detailed circuitry of FIG. 8C is operated from source voltage V1 and includes pushbutton controls.

In FIG. 8D, details are shown for the electric motor control circuitry. When switches T4 through T7 are closed, motor start relays MS1 through MS4 are energized when pushbutton PB1 is depressed and there is lock-up of relay KL2. Each motor start relay closes its associated contact, e.g. relay MS1 closes contacts MS1-1 through 3 and relay MS4 closes contacts MS4-1 through MS4-3. Motors 147, 247, 347 and 447 are started as a result from a three-phase source 604. The various gear head motors 314 and 316 of the shingling conveyor 300 are also operated from the three-phase source 604, with motor 314 being shown operated through an illustrative reversing switch 319 in FIG. 8C.

Figure 10A:
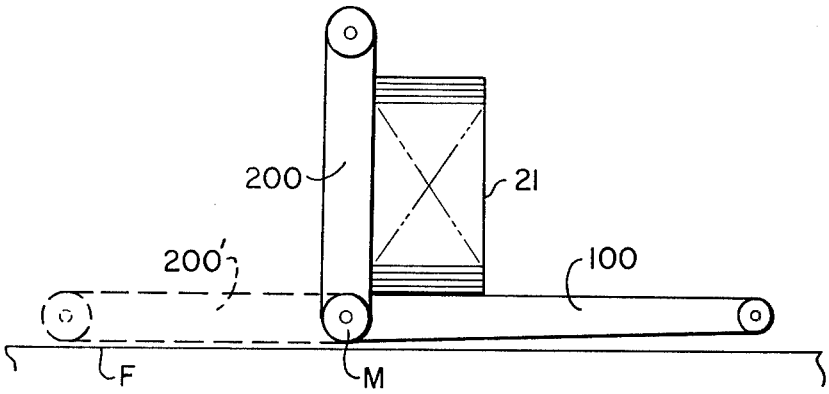
FIGS. 10A through 10C are a set of diagrams illustrating in FIGS. 10A, 10B and 10C an alternate embodiment of the invention.

The system 10 of FIG. 1 alternatively can be used to feed the stack 21 in a direction opposite to that produced in FIGS. 3A to 3D. As shown in FIG. 10A, the stack 21 is moved to the near side of the main pivot shaft M. The second conveyor 200 is then used to form the backrest and is elevated from the phantom position 200' to the vertical position shown.

Figure 10B:
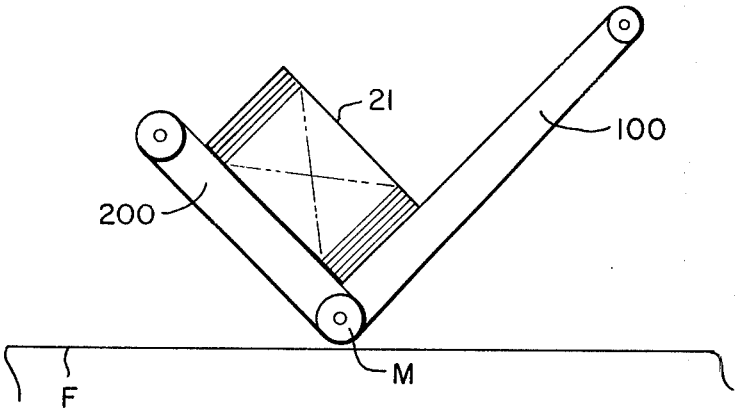
Figure 10C:
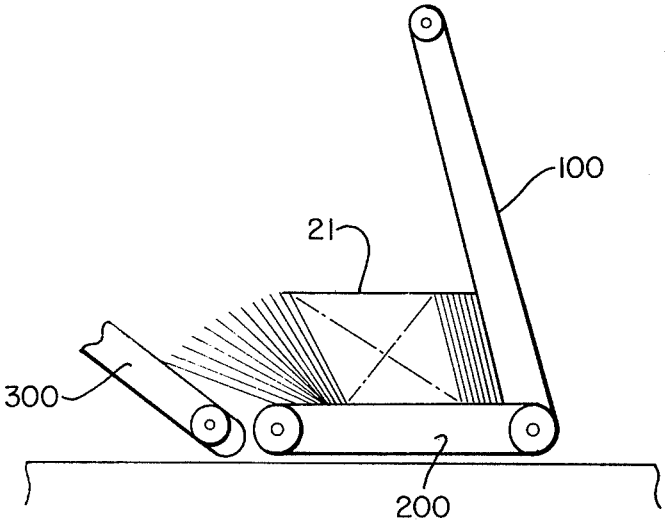

In the next steps, depicted in FIGS. 10B and 10C, the first conveyor 100 is operated to provide upset, and the second conveyor 200 is simultaneously lowered. Further operation of the conveyors 100 and 200, for example that shown in FIG. 10C can produce any initial shingling that is desired. Circuitry for producing the results of FIGS. 10A through 10C is included in FIGS. 8A through 8C.

Figure 11A:
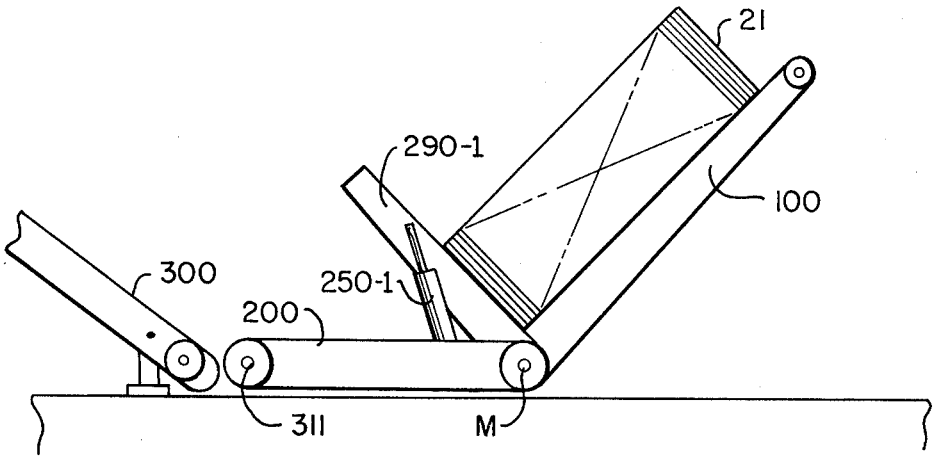
FIGS. 11A and 11B are a set of diagrams illustrating another alternative embodiment of the invention.
Figure 11B:
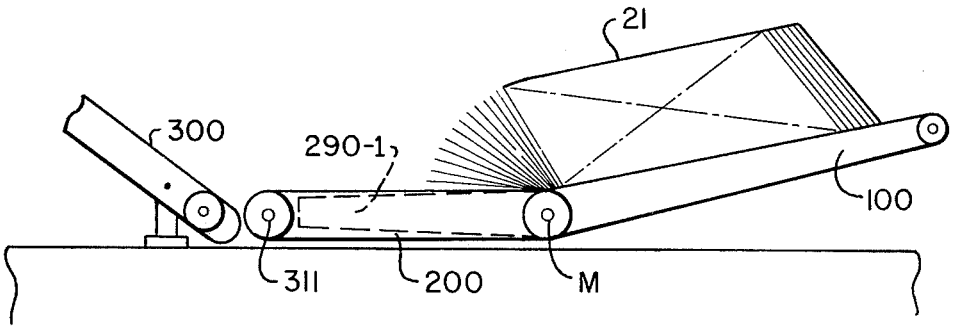

A further embodiment of the invention is shown in FIGS. 11A and 11B. For this embodiment the second conveyor 200 is fixed in position and has associated with it a pair of upset arms 290, of which one of the arms 290-1 is visible in FIGS. 9A and 9B. When the upset arms 290 have been returned to their initial position as shown in FIG. 9B, the further transport of the stack 21 is as previously described.

While various aspects of the invention have been set forth by the drawings and the specification, it is to be understood that the foregoing detailed description is for illustration only and that various changes in parts, as well as the substitution of equivalent constituents for those shown and described may be made without departing from the spirit and scope of the invention as set forth in the appended claims.

What is claimed is:

1. The method of transporting and reorienting a stack of materials, which comprises the steps of:

a. conveying the stack to a prescribed position on one driven feed conveyor;

b. pivoting another driven feed conveyor to a prescribed angular position relative to the one conveyor;

c. pivoting said one conveyor and upsetting said stack against the other conveyor; and d. returning one of the conveyors to a prescribed position for the feed of the upset stack therefrom.

2. The method of claim 1 wherein said one conveyor is returned to said prescribed position.

3. The method of claim 1 wherein said other conveyor is returned to said prescribed position.

4. The method of claim 1 wherein said other conveyor is initially pivoted to a position of substantially 90° relative to said one conveyor.

5. The method of claim 1 wherein said one conveyor is pivoted to a position of about 50 degrees relative to its initial position.

6. The method of claim 1 wherein said other conveyor is pivoted during upsetting simultaneously with the pivoting of said one conveyor.

7. The method of claim 6 wherein said other conveyor and said one conveyor are jointly pivoted to maintain the angle between them at about 90°.

8. The method of reorienting a stack of materials which comprises the steps of:

a. feeding the stack in a first direction along and by a first conveyor and a second conveyor;

b. terminating the drive of said conveyors;

c. upsetting the stack on said conveyors;

d. driving said first conveyor in a direction opposite to said first direction; and e. feeding the upset stack from said second conveyor in said first direction.

9. The method of claim 8 wherein said first conveyor is pivoted during upsetting to a prescribed angular position relative to said second conveyor.

10. The method of transporting and reorienting a stack of materials which comprises the steps of:

a. conveying the stack to a prescribed position on and by one driven feed conveyor;

b. pivoting another driven feed conveyor to a prescribed angular position relative to the one conveyor;

c. pivoting said stack and upsetting it against the other conveyor; and d. positioning said other conveyor for the feed of the upset stack therefrom.

11. The method of claim 10 wherein said stack is pivoted by one of the conveyors.

12. The method of claim 10 wherein said stack is pivoted by upset arms.

* * * * *